US011114768B2

(12) United States Patent
Rakib

(10) Patent No.: US 11,114,768 B2
(45) Date of Patent: Sep. 7, 2021

(54) MULTIBEAM ANTENNA DESIGNS AND OPERATION

(71) Applicant: Cohere Technologies, Inc., Santa Clara, CA (US)

(72) Inventor: Shlomo Rakib, Santa Clara, CA (US)

(73) Assignee: Cohere Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/660,665

(22) Filed: Oct. 22, 2019

(65) Prior Publication Data

US 2020/0153107 A1 May 14, 2020

Related U.S. Application Data

(63) Continuation of application No. PCT/US2018/029197, filed on Apr. 24, 2018.

(60) Provisional application No. 62/489,384, filed on Apr. 24, 2017.

(51) Int. Cl.
*H01Q 19/06* (2006.01)
*H01Q 21/08* (2006.01)

(52) U.S. Cl.
CPC ..... *H01Q 19/062* (2013.01); *H01Q 21/08* (2013.01)

(58) Field of Classification Search
CPC ..... H01Q 15/02–15/08; H01Q 19/06; H01Q 21/06–21/08
See application file for complete search history.

(56) References Cited

U.S. PATENT DOCUMENTS

| | | | |
|---|---|---|---|
| 4,754,493 | A | 6/1988 | Coates |
| 5,083,135 | A | 1/1992 | Nagy et al. |
| 5,182,642 | A | 1/1993 | Gersdorff et al. |
| 5,548,294 | A | 8/1996 | Sturza |
| 5,623,511 | A | 4/1997 | Bar-David et al. |
| 5,831,977 | A | 11/1998 | Dent |
| 5,872,542 | A | 2/1999 | Simons et al. |

(Continued)

FOREIGN PATENT DOCUMENTS

| | | | |
|---|---|---|---|
| CN | 1235720 | A | 11/1999 |
| CN | 101682316 | A | 3/2010 |

(Continued)

OTHER PUBLICATIONS

Office Action for U.S. Appl. No. 13/117,119, dated Aug. 5, 2013, 5 pages.

(Continued)

*Primary Examiner* — Hasan Islam
(74) *Attorney, Agent, or Firm* — Perkins Coie LLP

(57) ABSTRACT

An antenna system that includes a lens portion having a radiation-side curved surface and a feed-side reception surface, the lens portion structured to focus radio frequency radiations entering from the radiation-side curved surface on a focal point located at the feed reception surface and one or more antenna elements at or near the focal point, the one or more antenna elements being separated from each other by a fractional multiple of a center wavelength of a frequency band of operation, and each antenna element communicatively coupled to one or more radio frequency transmit and/or receive chain and being able to transmit and/or receive data from the radio frequency transmit chain according to a transmission scheme.

13 Claims, 39 Drawing Sheets

(56) References Cited

U.S. PATENT DOCUMENTS 5,956,624 A 9/1999 Hunsinger et al.
6,160,519 A 12/2000 Hemmi
6,212,246 B1 4/2001 Hendrickson
6,289,063 B1 9/2001 Duxbury
6,356,555 B1 3/2002 Rakib et al.
6,388,621 B1 5/2002 Lynch
6,426,983 B1 7/2002 Rakib et al.
6,608,864 B1 8/2003 Strait
6,631,168 B2 10/2003 Izumi
6,704,366 B1 3/2004 Combes et al.
6,867,741 B2 * 3/2005 Schaffner ..... G01S 19/23 343/753
6,956,814 B1 10/2005 Campanella
7,010,048 B1 3/2006 Shattil
7,327,812 B2 2/2008 Auer
7,392,018 B1 6/2008 Ebert et al.
7,689,049 B2 3/2010 Monro
7,773,685 B2 8/2010 Tirkkonen et al.
7,864,877 B2 1/2011 Hottinen
8,229,017 B1 7/2012 Lee et al.
8,259,845 B2 9/2012 Dent
8,401,131 B2 3/2013 Fety et al.
8,547,988 B2 10/2013 Hadani et al.
8,619,892 B2 12/2013 Vetter et al.
8,717,210 B2 5/2014 Eldar et al.
8,879,378 B2 11/2014 Rakib et al.
8,892,048 B1 11/2014 Turner
8,976,851 B2 3/2015 Hadani et al.
9,031,141 B2 5/2015 Hadani et al.
9,071,285 B2 6/2015 Hadani et al.
9,071,286 B2 6/2015 Hadani et al.
9,083,483 B1 7/2015 Rakib et al.
9,083,595 B2 7/2015 Rakib et al.
9,130,638 B2 9/2015 Hadani et al.
9,282,528 B2 3/2016 Hashimoto
9,294,315 B2 3/2016 Hadani et al.
9,444,514 B2 9/2016 Hadani et al.
9,548,840 B2 1/2017 Hadani et al.
9,553,984 B2 1/2017 Krause et al.
9,590,300 B2 * 3/2017 Artemenko ..... H04B 7/00
9,590,779 B2 3/2017 Hadani et al.
9,634,719 B2 4/2017 Rakib et al.
9,660,851 B2 5/2017 Hadani et al.
9,668,148 B2 5/2017 Hadani et al.
9,712,354 B2 7/2017 Hadani et al.
9,729,281 B2 8/2017 Hadani et al.
10,116,058 B2 * 10/2018 Oh ..... H01Q 15/10
2001/0031022 A1 10/2001 Petrus et al.
2001/0033614 A1 10/2001 Hudson
2001/0046205 A1 11/2001 Easton et al.
2002/0001308 A1 1/2002 Heuer
2002/0034191 A1 3/2002 Shattil
2002/0181388 A1 12/2002 Jain et al.
2002/0181390 A1 12/2002 Mody et al.
2002/0181607 A1 12/2002 Izumi
2003/0073464 A1 4/2003 Giannakis et al.
2003/0185295 A1 10/2003 Yousef
2003/0235147 A1 12/2003 Walton et al.
2004/0044715 A1 3/2004 Aldroubi et al.
2004/0174812 A1 9/2004 Murakami et al.
2004/0189581 A1 9/2004 Sako et al.
2004/0218523 A1 11/2004 Varshney et al.
2005/0157778 A1 7/2005 Trachewsky et al.
2005/0157820 A1 7/2005 Wongwirawat et al.
2005/0180517 A1 8/2005 Abe
2005/0207334 A1 9/2005 Hadad
2005/0219126 A1 10/2005 Rebeiz et al.
2005/0251844 A1 11/2005 Martone et al.
2006/0008021 A1 1/2006 Bonnet
2006/0039270 A1 2/2006 Strohmer et al.
2007/0001918 A1 * 1/2007 Ebling ..... H01Q 15/02 343/753
2007/0014272 A1 1/2007 Palanki et al.
2007/0038691 A1 2/2007 Candes et al.
2007/0078661 A1 4/2007 Sriram et al.
2007/0104283 A1 5/2007 Han et al.
2007/0110131 A1 5/2007 Guess et al.
2007/0211952 A1 9/2007 Faber et al.
2007/0216596 A1 9/2007 Lewis et al.
2007/0237181 A1 10/2007 Cho et al.
2007/0253465 A1 11/2007 Muharemovic et al.
2007/0253504 A1 11/2007 Hasegawa
2008/0043857 A1 2/2008 Dias et al.
2008/0117999 A1 5/2008 Kadous et al.
2008/0186843 A1 8/2008 Ma et al.
2008/0187062 A1 8/2008 Pan et al.
2008/0232504 A1 9/2008 Ma et al.
2008/0310383 A1 12/2008 Kowalski
2009/0080403 A1 3/2009 Hamdi
2009/0092259 A1 4/2009 Jot et al.
2009/0103593 A1 4/2009 Bergamo
2009/0122854 A1 5/2009 Zhu et al.
2009/0161804 A1 6/2009 Chrabieh et al.
2009/0204627 A1 8/2009 Hadani
2009/0222226 A1 9/2009 Baraniuk et al.
2009/0303961 A1 12/2009 Popovic et al.
2010/0001901 A1 1/2010 Baraniuk et al.
2010/0008432 A1 1/2010 Kim et al.
2010/0027608 A1 2/2010 Priotti
2010/0111138 A1 5/2010 Hosur et al.
2010/0142476 A1 6/2010 Jiang et al.
2010/0187914 A1 7/2010 Rada et al.
2010/0238787 A1 9/2010 Guey
2010/0277308 A1 11/2010 Potkonjak
2010/0303136 A1 12/2010 Ashikhmin et al.
2010/0322349 A1 12/2010 Lee et al.
2011/0007789 A1 1/2011 Garmany
2011/0110532 A1 5/2011 Svendsen
2011/0116489 A1 5/2011 Grandhi
2011/0116516 A1 5/2011 Hwang et al.
2011/0126071 A1 5/2011 Han et al.
2011/0131463 A1 6/2011 Gunnam
2011/0216808 A1 9/2011 Tong et al.
2011/0286502 A1 11/2011 Adachi et al.
2011/0287778 A1 11/2011 Levin et al.
2011/0292971 A1 12/2011 Hadani et al.
2011/0293030 A1 12/2011 Rakib et al.
2011/0299379 A1 12/2011 Sesia et al.
2011/0305267 A1 12/2011 Riu et al.
2012/0021769 A1 1/2012 Lindoff et al.
2012/0051457 A1 3/2012 Ma et al.
2012/0140716 A1 6/2012 Baldemair et al.
2012/0170684 A1 7/2012 Yim et al.
2012/0201322 A1 8/2012 Rakib et al.
2012/0213098 A1 8/2012 Sun
2012/0235795 A1 9/2012 Liao et al.
2012/0269201 A1 10/2012 Atungsiri et al.
2012/0272117 A1 10/2012 Stadelmeier et al.
2012/0320994 A1 12/2012 Loghin et al.
2013/0021977 A1 1/2013 Yang et al.
2013/0058390 A1 3/2013 Haas et al.
2013/0077579 A1 3/2013 Cho et al.
2013/0083661 A1 4/2013 Gupta et al.
2013/0121497 A1 5/2013 Smaragdis et al.
2013/0230010 A1 9/2013 Kim et al.
2013/0260787 A1 10/2013 Hashimoto
2013/0279627 A1 10/2013 Wu et al.
2013/0315133 A1 11/2013 Wang et al.
2014/0139370 A1 5/2014 Hamner et al.
2014/0143639 A1 5/2014 Loghin et al.
2014/0161154 A1 6/2014 Hadani et al.
2014/0169385 A1 6/2014 Hadani et al.
2014/0169406 A1 6/2014 Hadani et al.
2014/0169433 A1 6/2014 Hadani et al.
2014/0169436 A1 6/2014 Hadani et al.
2014/0169437 A1 6/2014 Hadani et al.
2014/0169441 A1 6/2014 Hadani et al.
2014/0247803 A1 9/2014 Arambepola et al.
2014/0348252 A1 11/2014 Siohan et al.
2014/0364128 A1 12/2014 Lee et al.
2015/0117395 A1 4/2015 Hadani et al.
2015/0326273 A1 11/2015 Rakib et al.
2015/0327085 A1 11/2015 Hadani et al.
2015/0382231 A1 12/2015 Jabbar et al.

(56) References Cited

U.S. PATENT DOCUMENTS

| | | | |
|---|---|---|---|
| 2016/0043835 | A1 | 2/2016 | Hadani et al. |
| 2016/0135132 | A1 | 5/2016 | Donepudi et al. |
| 2016/0182269 | A1 | 6/2016 | Hadani et al. |
| 2016/0191217 | A1 | 6/2016 | Hadani et al. |
| 2016/0191280 | A1 | 6/2016 | Hadani et al. |
| 2016/0254889 | A1 | 9/2016 | Shattil |
| 2016/0277225 | A1 | 9/2016 | Frenne et al. |
| 2016/0309345 | A1 | 10/2016 | Tehrani et al. |
| 2016/0380743 | A1 | 12/2016 | Rakib |
| 2016/0381576 | A1 | 12/2016 | Hadani et al. |
| 2017/0012749 | A1 | 1/2017 | Rakib et al. |
| 2017/0012810 | A1 | 1/2017 | Rakib et al. |
| 2017/0019297 | A1 | 1/2017 | Rakib |
| 2017/0033899 | A1 | 2/2017 | Rakib et al. |
| 2017/0040711 | A1 | 2/2017 | Rakib et al. |
| 2017/0078054 | A1 | 3/2017 | Hadani et al. |
| 2017/0099122 | A1 | 4/2017 | Hadani et al. |
| 2017/0099607 | A1 | 4/2017 | Hadani et al. |
| 2017/0149594 | A1 | 5/2017 | Rakib et al. |
| 2017/0149595 | A1 | 5/2017 | Rakib et al. |
| 2017/0201354 | A1 | 7/2017 | Hadani et al. |
| 2017/0207817 | A1 | 7/2017 | Hadani et al. |
| 2017/0222700 | A1 | 8/2017 | Hadani et al. |
| 2017/0230215 | A1 | 8/2017 | Rakib et al. |
| 2017/0244524 | A1 | 8/2017 | Hadani et al. |

FOREIGN PATENT DOCUMENTS

| | | | |
|---|---|---|---|
| CN | 101939935 | A | 1/2011 |
| EP | 1432168 | A1 | 6/2004 |
| JP | 2011127910 | A | 6/2011 |
| WO | 2007004297 | | 1/2007 |
| WO | 2011137699 | A1 | 11/2011 |
| WO | 2011150315 | | 12/2011 |
| WO | 2013148546 | | 10/2013 |
| WO | 2014004585 | | 1/2014 |
| WO | 2016014596 | | 1/2016 |
| WO | 2016014598 | | 1/2016 |
| WO | 2016176642 | | 11/2016 |
| WO | 2016183230 | | 11/2016 |
| WO | 2016183240 | | 11/2016 |
| WO | 2016209848 | | 12/2016 |
| WO | 2017003952 | | 1/2017 |
| WO | 2017011478 | | 1/2017 |

OTHER PUBLICATIONS

Notice of Allowance for U.S. Appl. No. 13/117,119, dated Feb. 28, 2014, 13 pages.
Banelli, P. et al., "Modulation Formats and Waveforms for 5G Networks: Who Will Be the Heir of OFDM?," IEEE Signal Processing Magazine, vol. 81, pp. 80-93, Nov. 2014.
El Hattachi, R. et al., "NGMN 5G Initiative White Paper," NGMN Alliance, Feb. 17, 2015. [Online]. Available: https://www.ngmn.org/uploads/media/NGMN_5G_White_Paper_V1_0.pdf, 125 pages.
Rusek, F. et al., "Scaling Up MIMO, Opportunities and Challenges with Very Large Arrays," IEEE Signal Processing Magazine, pp. 40-60 (2013).
Vodafone, "Cellular Internet of Things: Architectural Aspects," RP-150869, 3GPP RAN#68, Malmo, Sweden (Jun. 9, 2015), 19 pages.
Supplementary European Search Report for European Application No. 11787483.4, dated Sep. 9, 2014, 6 pages.
International Search Report and Written Opinion for International Application No. PCT/US2011/038302, dated Nov. 15, 2011, 8 pages.
International Preliminary Report on Patentability for International Application No. PCT/US2011/038302, dated Dec. 4, 2012, 7 pages.
Office Action for U.S. Appl. No. 13/117,124, dated Feb. 22, 2013, 7 pages.
Notice of Allowance for U.S. Appl. No. 13/117,124, dated Aug. 8, 2013, 10 pages.
Office Action for U.S. Appl. No. 14/605,957, dated Jun. 22, 2017, 6 pages.
Supplementary European Search Report for European Application No. 13809004.8, dated Apr. 14, 2016, 8 pages.
Communication Pursuant to Article 94(3) EPC for European Application No. 13809004.8, dated Feb. 17, 2017, 5 pages.
Notice of Allowance for U.S. Appl. No. 13/927,087, dated Feb. 25, 2015, 9 pages.
Office Action for U.S. Appl. No. 13/927,087, dated Nov. 12, 2014, 14 pages.
Gurevich, S. et al. "Group Representation Design of Digital Signals and Sequences," S.W. Golomb et al. (eds.), SETA 2008, LNCS 5203, pp. 153-166, Springer-Verlag Berlin Heidelberg (2008).
International Search Report and Written Opinion for International Application No. PCT/US2013/047723, dated Oct. 29, 2013, 17 pages.
International Preliminary Report on Patentability for International Application No. PCT/US2013/047723, dated Dec. 31, 2014, 15 pages.
Notice of Allowance for U.S. Appl. No. 13/927,088, dated Feb. 18, 2015, 7 pages.
Office Action for U.S. Appl. No. 13/927,088, dated Nov. 28, 2014, 13 pages.
Notice of Allowance for U.S. Appl. No. 13/927,086, dated Dec. 26, 2014, 8 pages.
Supplemental Notice of Allowability for U.S. Appl. No. 13/927,086, dated Mar. 19, 2015, 4 pages.
Office Action for U.S. Appl. No. 13/927,086, dated Oct. 14, 2014, 10 pages.
Office Action for U.S. Appl. No. 13/927,089, dated Dec. 24, 2014, 13 pages.
Office Action for U.S. Appl. No. 13/927,089, dated Aug. 14, 2015, 7 pages.
Supplemental Notice of Allowability for U.S. Appl. No. 13/927,091, dated Jun. 11, 2015, 4 pages.
Notice of Allowance for U.S. Appl. No. 13/927,091, dated Apr. 24, 2015, 8 pages.
Office Action for U.S. Appl. No. 13/927,091, dated Jan. 27, 2015, 15 pages.
Office Action for U.S. Appl. No. 13/927,092, dated Oct. 8, 2014, 5 pages.
Notice of Allowance for U.S. Appl. No. 13/927,092, dated Oct. 24, 2014, 7 pages.
Office Action for U.S. Appl. No. 13/927,095, dated Apr. 30, 2015, 11 pages.
Office Action for U.S. Appl. No. 13/927,095, dated Nov. 4, 2015, 9 pages.
Office Action for U.S. Appl. No. 13/927,095, dated Jun. 1, 2016, 10 pages.
Office Action for U.S. Appl. No. 14/717,886, dated Apr. 19, 2016, 10 pages.
Office Action for U.S. Appl. No. 14/709,377, dated Dec. 11, 2015, 12 pages.
Office Action for U.S. Appl. No. 14/709,377, dated Jul. 13, 2016, 17 pages.
Examination Report No. 1 for Australian Application No. 2013239970, dated Dec. 8, 2015, 3 pages.
"AT&T Annual Report 2014," Opening Our Network [Online]. Retrieved from the Internet: Sep. 22, 2016. <URL: http://www.att.com/Investor/ATT_Annual/2014/att_introduces_new_concepts_for_telecom_network.html>, 5 pages.
CATT, "UL ACK/NACK transmission methods for LTE-A," 3GPP TSG RAN WG1 Meeting #60bis, R1-102453, Beijing, China, 12-16, Apr. 2010, 8 pages.
Toskala, A. et al., "Physical Layer," Chapter 5 In: "LTE for UMTS: OFDMA and SC-FDMA Based Radio Access," Holma, H. et al. (eds.), John Wiley & Sons, Ltd., United Kingdom, 2009, pp. 83-135.
Mecklenbrauker, W., "A Tutorial on Non-Parametric Bilinear Time-Frequency Signal Representations," In: Time and Frequency Representation of Signals and Systems, Longo, G. et al. (eds.), Springer-Verlag Wien, vol. 309, pp. 11-68 (1989).
Nehorai, A. et al., "Muri: Adaptive waveform design for full spectral dominance (2005-2010)," AFOSR FA9550-05-1-0443, Final Report,

(56) References Cited

OTHER PUBLICATIONS

[online], Mar. 11, 2011 Retrieved on May 11, 2013, Retrieved from the Internet <URL: http://oai.dtic.mil/oai/oai?verb=getRecord&metadataPrefix=html&identifier=ADA565420>, 103 pages.
Office Action for Japanese Application No. 2015-518647, dated Jul. 7, 2015, 10 pages.
Office Action for U.S. Appl. No. 14/754,596, dated Apr. 19, 2016, 18 pages.
Office Action for U.S. Appl. No. 14/809,129, dated Jul. 19, 2016, 5 pages.
Office Action for U.S. Appl. No. 15/617,962, dated Sep. 6, 2017, 10 pages.
International Search Report and Written Opinion for International Application No. PCT/US2016/050825, dated Feb. 8, 2017, 12 pages.
International Search Report and Written Opinion for International Application No. PCT/US2016/052524, dated Dec. 20, 2016, 8 pages.
Office Action for U.S. Appl. No. 15/374,995, dated Aug. 7, 2017, 6 pages.
International Search Report and Written Opinion for International Application No. PCT/US2017/025797, dated Jun. 21, 2017, 6 pages.
International Search Report and Written Opinion for International Application No. PCT/US2016/030259, dated Aug. 4, 2016, 13 pages.
Office Action for U.S. Appl. No. 15/152,464, dated Apr. 6, 2017, 10 pages.
Examination Report No. 1 for Australian Application No. 2013280487, dated May 2, 2016, 3 pages.
International Search Report and Written Opinion for International Application No. PCT/US2016/031928, dated Oct. 7, 2016, 10 pages.
Office Action for U.S. Appl. No. 15/188,946, dated May 8, 2017, 14 pages.
International Search Report and Written Opinion for International Application No. PCT/US2016/038584, dated Sep. 26, 2016, 8 pages.
Office Action for U.S. Appl. No. 15/187,668, dated Feb. 16, 2017, 6 pages.
International Search Report and Written Opinion for International Application No. PCT/US2016/031909, dated Aug. 11, 2016, 13 pages.
Office Action for U.S. Appl. No. 15/194,494, dated May 5, 2017, 16 pages.
International Search Report and Written Opinion for International Application No. PCT/US2016/039662, dated Nov. 29, 2016, 14 pages.
Office Action for U.S. Appl. No. 15/436,653, dated Jun. 2, 2017, 10 pages.
Office Action for U.S. Appl. No. 15/208,545, dated Aug. 21, 2017, 15 pages.
International Search Report and Written Opinion for International Application No. PCT/US2016/041940, dated Oct. 20, 2016, 8 pages.
Supplementary European Search Report for European Application No. 13768150.8, dated Oct. 30, 2015, 7 pages.
International Search Report and Written Opinion for International Application No. PCT/US2013/033652, dated Jun. 12, 2013, 8 pages.
International Search Report and Written Opinion for International Application No. PCT/US2015/041417, dated Oct. 1, 2015, 7 pages.
Office Action for U.S. Appl. No. 14/805,407, dated Dec. 14, 2016, 7 pages.
International Search Report and Written Opinion for International Application No. PCT/US2015/041420, dated Oct. 1, 2015, 6 pages.
Extended European Search Report for Application No. 18791947.7 dated Dec. 15, 2020, 15 pages.
Sk, Shadar Basha et al.: "Implementation of Windowing Technique for Minimizing the Side Lobes in Antenna Array Design", International Journal of Research in Science & Technology, Dec. 1, 2014, XP055756528, ISSN: 2349-0845, DOI: http://oaji.ent/articles/2014/1542-1419935638.pdf.

* cited by examiner

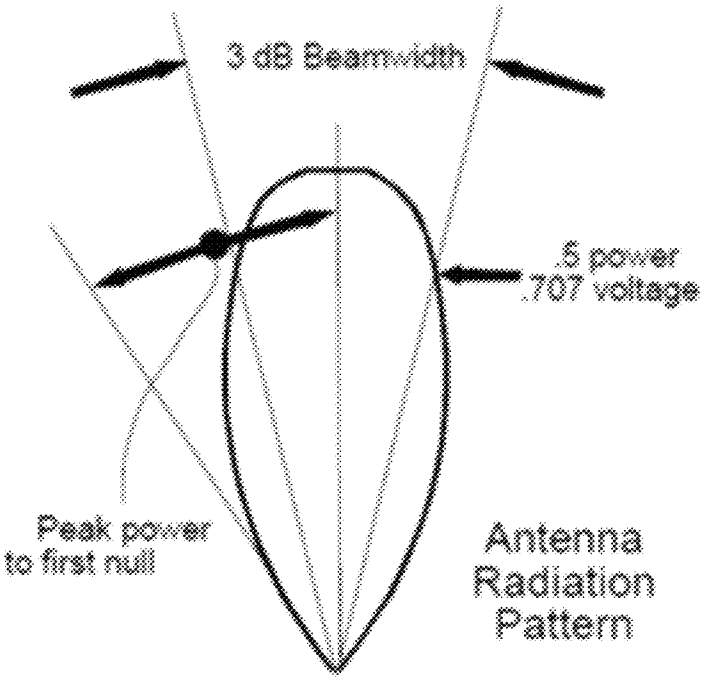
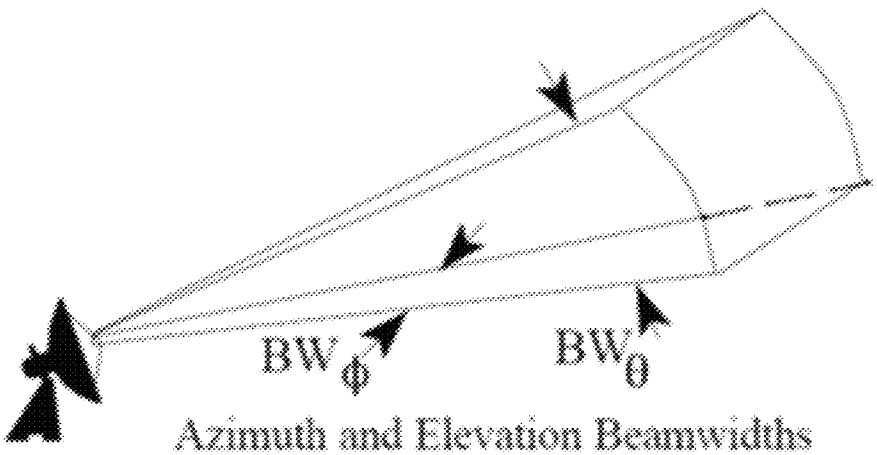
FIG. 6

802
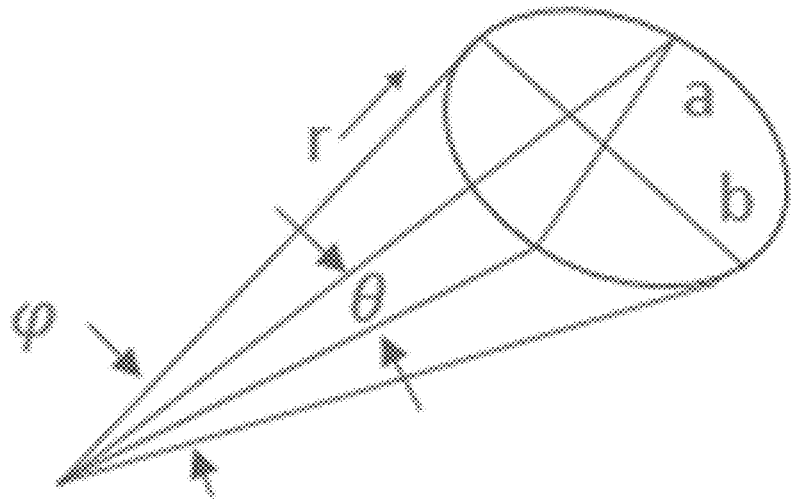
$$\theta = BW_{\theta} \quad \varphi = BW_{\varphi}$$
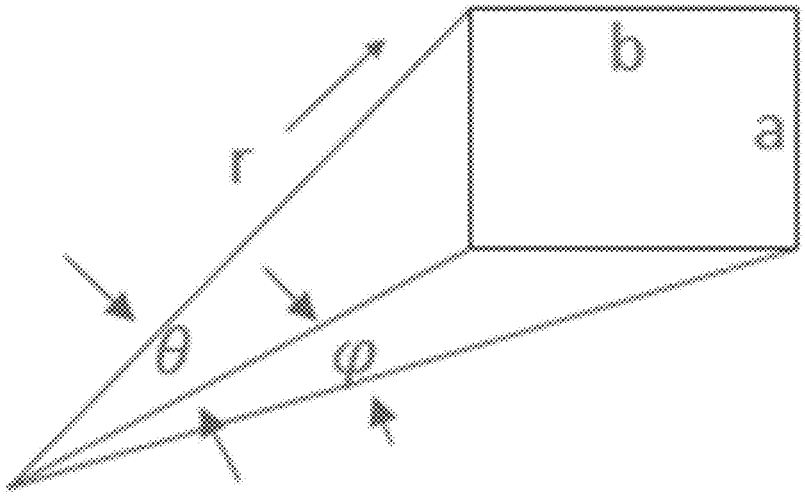
FIG. 8

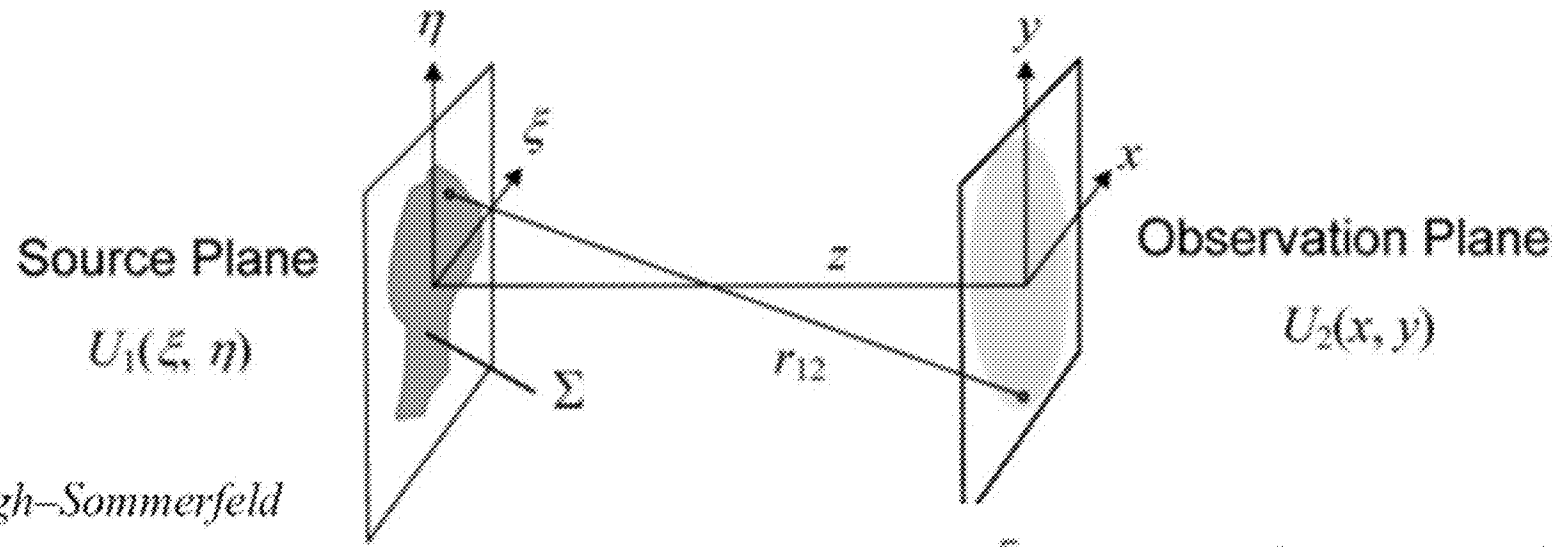

*Rayleigh–Sommerfeld*

$$U_2(x,y) = \frac{z}{j\lambda}\iint_{\Sigma} U_1(\xi,\eta)\frac{\exp(jkr_{12})}{r_{12}^2}d\xi d\eta. \qquad r_{12} \approx z\left[1+\frac{1}{2}\left(\frac{x-\xi}{z}\right)^2+\frac{1}{2}\left(\frac{y-\eta}{z}\right)^2\right]$$

$$U_2(x,y) = \frac{e^{jkz}}{j\lambda z}\iint U_1(\xi,\eta)\exp\left\{j\frac{k}{2z}\left[(x-\xi)^2+(y-\eta)^2\right]\right\}d\xi d\eta.$$

$$U_2(x_2,y_2) = \frac{\exp(jkz)}{j\lambda z}\exp\left[j\frac{k}{2z}\left(x^2+y^2\right)\right] \qquad z >> \left(\frac{k(\xi^2+\eta^2)}{2}\right)_{max},$$

$$\times\iint U_1(\xi,\eta)\exp\left[-j\frac{2\pi}{\lambda z}(x\xi+y\eta)\right]d\xi d\eta.$$

Fraunhofer approximation

FIG. 11

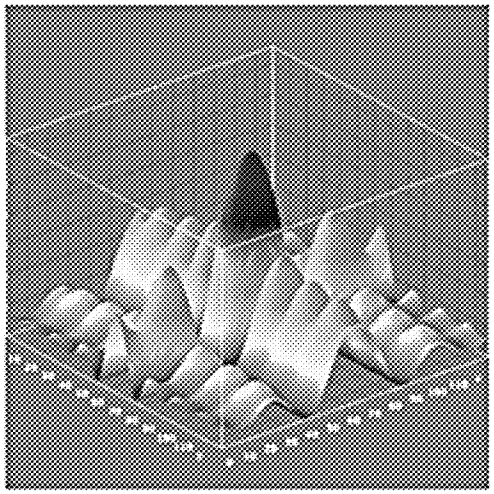

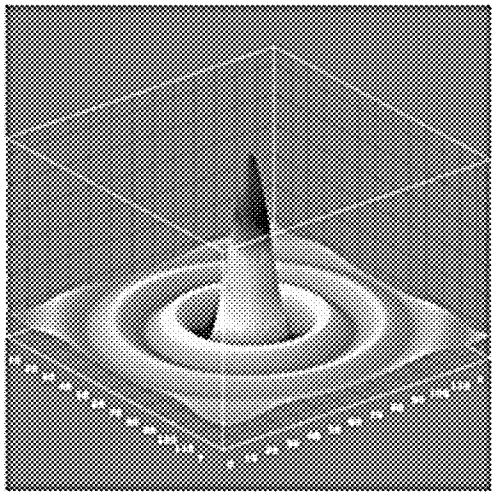

$$\mathrm{rect}(x) = \begin{cases} 1, & |x| < \frac{1}{2} \\ \frac{1}{2}, & |x| = \frac{1}{2} \\ 0, & \text{otherwise} \end{cases}$$

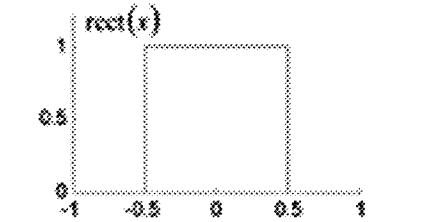

$$\mathrm{rect}\left(\frac{x}{a}\right)$$

$$\mathrm{circ}\left(\frac{\sqrt{x^2+y^2}}{a}\right)$$

$$\mathrm{circ}\left(\sqrt{x^2+y^2}\right) = \begin{cases} 1 & \sqrt{x^2+y^2} < \frac{1}{2} \\ \frac{1}{2} & \sqrt{x^2+y^2} = \frac{1}{2} \\ 0 & \text{otherwise} \end{cases}$$

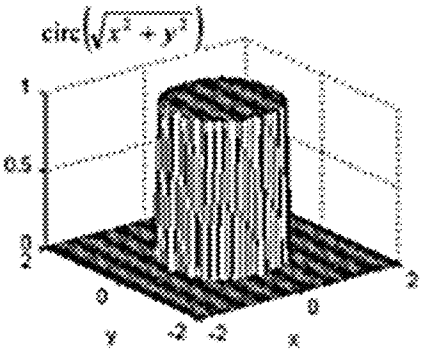

$$|a|\,\mathrm{sinc}(af_X)$$

$$a^2\frac{J_1\left(2\pi a\sqrt{f_X^2+f_Y^2}\right)}{a\sqrt{f_X^2+f_Y^2}}$$

FIG. 12

$$\text{Radiation Pattern (in units of dB)} \propto 20\log_{10}\left(\left|\frac{\sin(X)}{X}\right|\right)$$

First null = $\sin^{-1}\left(\frac{\lambda}{D}\right) \approx \frac{\lambda}{D}\ [rad]$

| | Radiation Pattern | Explanation |
|---|---|---|
| 0 | 0 dB | peak of main beam |
| 3.14 = π | −∞ dB | first null |
| 4.49 = 3 π/2 | −13.26 dB | peak of first sidelobe |
| 6.28 = 2 π | −∞ dB | second null |
| 7.72 = 5 π/2 | −17.83 dB | peak of second sidelobe |

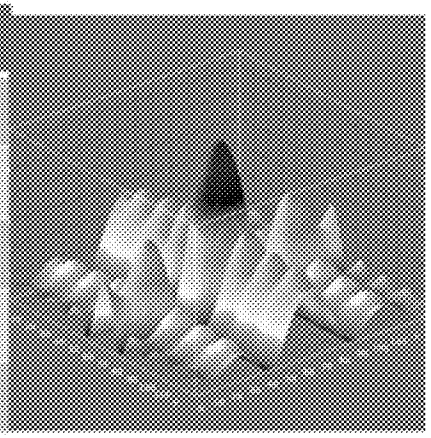

$$\text{Radiation Pattern (in units of dB)} \propto 10\log_{10}\left(\left|2\frac{J_1(X)}{X}\right|^2\right)$$

$ka\theta_1 = 3.832 \qquad \theta_1 = 1.22\frac{\lambda}{D}$

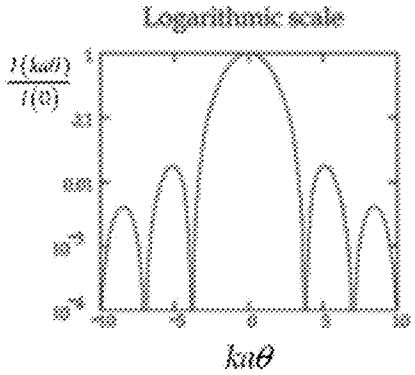

| | Radiation Pattern | Explanation |
|---|---|---|
| 0 | 0 dB | peak of main beam |
| 3.83 | −∞ dB | first null |
| 5.14 | −17.57 dB | peak of first sidelobe |
| 7.02 | −∞ dB | second null |
| 8.42 | −23.81 dB | peak of second sidelobe |

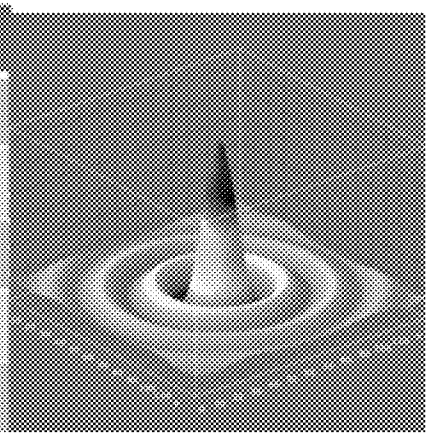

FIG. 13

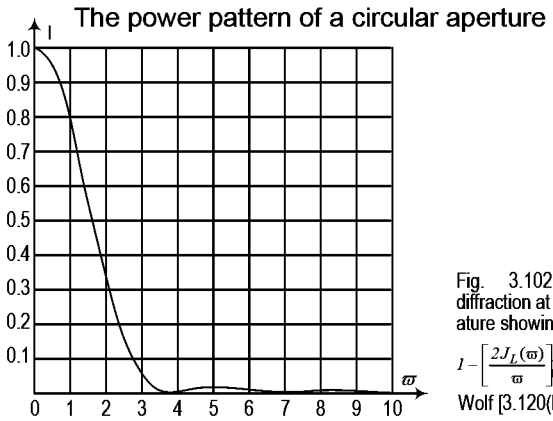

Fig. 3.102. Fraunhofer diffraction at a circular aperature showing the function $1-\left[\frac{2J_L(\varpi)}{\varpi}\right]^2$ (after Born-Wolf [3.120(b)])

Table 3.25. The first 3 subsidiary minima and maxima of the function $\left[\frac{2J_L(\varpi)}{\varpi}\right]^2$ (after Born-Wolf [3.120(b)])

| *Case* | $\varpi$ | $\left[\frac{2J_L(\varpi)}{\varpi}\right]^2$ |
|---|---|---|
| Central max. | 0 | 1 |
| First min. | 1.220π = 3.832 | 0 |
| Max. | 1.635π = 5.136 | 0.0175 |
| Second min. | 2.233π = 7.016 | 0 |
| Max. | 2.679π = 8.417 | 0.0042 |
| Third min. | 3.238π = 10.174 | 0 |
| Max. | 3.699π = 11.620 | 0.0016 |

Table 6.1 Normalized power pattern characteristics produced by different aperture illumination according to (5.32)

| $p$ | $K$ | HPBW $= k_1\frac{\lambda}{D}$ /rad | BWFN $= k_2\frac{\lambda}{D}$ /rad | $\eta$A | First side lobe /dB |
|---|---|---|---|---|---|
| 0 | | 1.02 | 2.44 | 1.00 | −17.6 |
| 1 | | 1.27 | 3.26 | 0.75 | −24.6 |
| 2 | | 1.47 | 4.06 | 0.56 | −30.6 |
| 3 | | 1.65 | 4.84 | 0.44 | |
| 4 | | 1.81 | 5.58 | 0.36 | |
| 1 | 0.25 | 1.17 | 2.98 | 0.87 | −23.7 |
| 2 | 0.25 | 1.23 | 3.36 | 0.81 | −32.3 |
| 1 | 0.50 | 1.13 | 2.66 | 0.92 | −22.0 |
| 2 | 0.50 | 1.16 | 3.02 | 0.88 | −26.5 |

FIG. 16

Uniform $$w(n) = \cos^{\alpha}\left(\frac{\pi n}{N-1} - \frac{\pi}{2}\right)$$

$$w(n) = \cos^{\alpha}\left(\frac{\pi n}{N-1} - \frac{\pi}{2}\right)$$

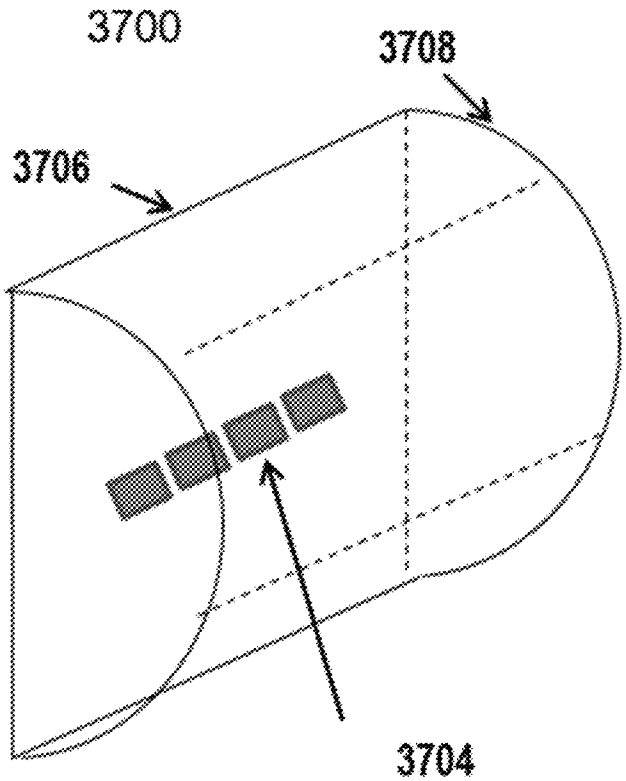
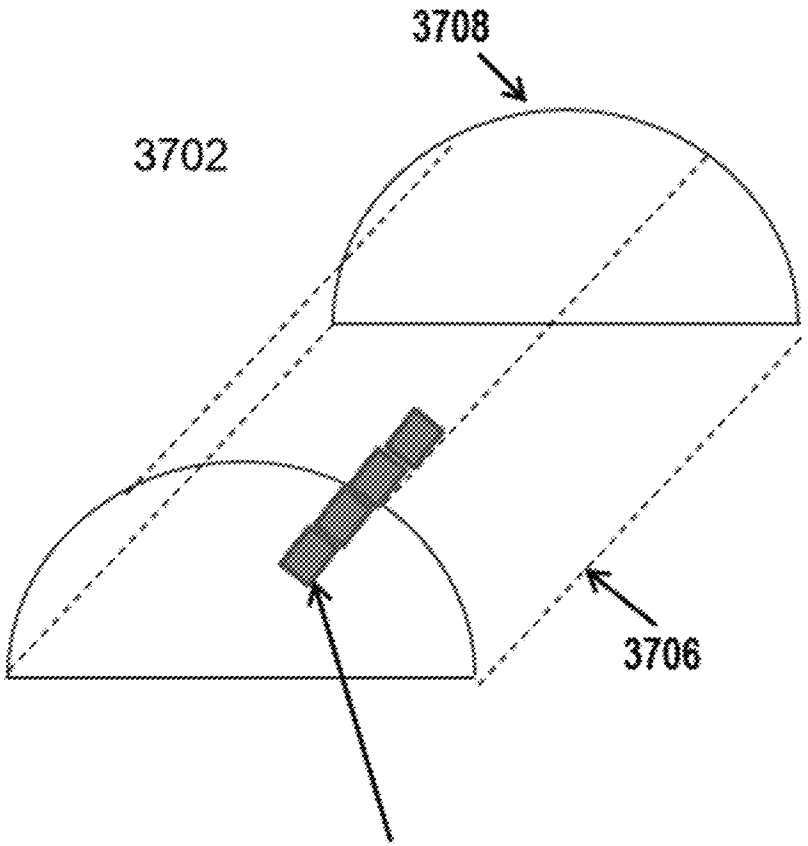
FIG. 37

MULTIBEAM ANTENNA DESIGNS AND OPERATION

CROSS-REFERENCE TO RELATED APPLICATIONS

This patent document is a continuation of PCT Application No. PCT/US2018/029197 entitled "MULTIBEAM ANTENNA DESIGNS AND OPERATION" filed on Apr. 24, 2018, which claims priority to and benefits of U.S. Provisional Patent Application No. 62/489,384 entitled "MULTIBEAM ANTENNA DESIGNS AND OPERATION" filed on Apr. 24, 2017. The entire contents of the aforementioned patent applications are incorporated by reference as part of the disclosure of this patent document.

TECHNICAL FILED

The present document relates to antenna design and operation, and more particularly to design and operation of antennas capable of transmitting or receiving multiple radiation beams.

BACKGROUND

Due to an explosive growth in the number of wireless user devices and the amount of wireless data that these devices can generate or consume, current wireless communication networks are fast running out of bandwidth to accommodate such a high growth in data traffic and provide high quality of service to users.

Various efforts are underway in the telecommunication industry to come up with next generation of wireless technologies that can keep up with the demand on performance of wireless devices and networks.

SUMMARY

This document discloses techniques for the design and operation of multibeam antennas.

In one example aspect, an antenna system is disclosed. The antenna system includes a lens portion having a radiation-side curved surface and a feed reception surface, the lens portion structured to focus radio frequency radiations entering from the radiation-side curved surface on a focal point located at the feed reception surface and one or more antenna elements, the one or more antenna elements being separated from each other by a fractional multiple of a center wavelength of a frequency band of operation, and each antenna element communicatively coupled to one or more radio frequency transmit and/or receive chain and being able to transmit and/or receive data from the radio frequency transmit chain according to a transmission scheme.

In another example aspect, another antenna having a lens portion and one or more antenna elements is disclosed. The lens portion is hemispherical in shape and comprises multiple hemispherical concentric shells having varying radio frequency refractive indices. The one or more antenna elements are arranged in a three-dimensional array on a surface of the lens, each antenna element communicatively coupled to one or more radio frequency (RF) transmit and/or receive chain and being able to transmit and/or receive data from a corresponding chain according to a transmission scheme.

In yet another example embodiment, another antenna system is disclosed. The antenna includes multiple data stream inputs, each data stream input carrying source data bits for one or more users, a signal processing stage that processes the multiple data stream inputs to generate multiple beams, where each beam represents a signal carried over one radio frequency beam, a feed network that couples each of the multiple beam to a number of antenna elements, and a lens portion positioned to radiate radio frequency transmissions from the antenna elements in a target direction.

In yet another example embodiment, a disclosed antenna system includes a lens portion that is semi-cylindrical in shape and comprises multiple semi-cylindrical concentric shells having varying radio frequency refractive indices, and one or more antenna elements arranged in a three dimensional array on a surface of the lens, each antenna element communicatively coupled to one or more radio frequency transmit and/or receive chain and being able to transmit and/or receive data from a corresponding chain according to a transmission scheme.

In yet another example embodiment, a method of operating an antenna system described herein is disclosed.

In yet another example embodiment, method of forming a mesh network is disclosed. The method includes performing, during a discovery phase, omnidirectional signal transmission to cover a range of operation, receiving acknowledgements from one or more other devices during the discovery phase, and modifying the omnidirectional signal transmission into a multibeam transmission such that each beam of the multibeam transmission cover the one or more other devices from whom the acknowledgements are received.

These, and other, features are described in this document.

DESCRIPTION OF THE DRAWINGS

Drawings described herein are used to provide a further understanding and constitute a part of this application. Example embodiments and illustrations thereof are used to explain the technology rather than limiting its scope.

FIG. 6 shows examples of parameters relevant to the calculation of antenna gain.

FIG. 8 depicts an example of parametric representation of an antenna beam.

FIG. 11 depicts antenna source plane and observation plane examples.

FIG. 12 shows examples of window functions.

FIG. 13 shows another example of windows function.

FIG. 16 shows an example of a power pattern for a circular aperture antenna.

FIG. 37 shows an example of an antenna system having a semi-cylindrical lens.

DETAILED DESCRIPTION

To make the purposes, technical solutions and advantages of this disclosure more apparent, various embodiments are described in detail below with reference to the drawings. Unless otherwise noted, embodiments and features in embodiments of the present document may be combined with each other. Furthermore, while certain design and operation features of the described antenna systems are described from the perspective of transmission or reception, it will be understood that a corresponding reverse symmetry exists between transmission functionality and reception functionality of antenna systems.

Section headings are used in the present document to improve readability of the description and do not in any way limit the techniques and embodiments to the respective sections only.

To meet ever-increasing bandwidth demand in wireless networks, various technologies have been introduced in the past few years after the initial deployment of cellular wireless networks. For example, recently introduced multi-user (MU) multiple-input, multiple-output (MIMO) techniques use multiple antennas (e.g., 4 or 8) for transmission and/or reception of signals to accommodate higher number of users. In a MU-MIMO system, a transmitter may form multiple transmission beams, directed to the multiple users. Such configurations usually require that a large number of computations be performed at the transmitter to correctly generate the transmission beams. Such configurations are therefore not only computationally intense but may result in higher power consumption and unsatisfactory results if the transmitter is not able to keep up its calculations when channels to multiple users are rapidly changing. Furthermore, conventional MIMO antenna designs often use linear antenna elements and placing of multiple linear antennas in proximity of each other can be challenging, especially when antennas are design to fit an aesthetically acceptable shape or when space is constrained to curvilinear form (e.g., an outer casing of a street light).

The techniques described in the present document can be used by some embodiments to overcome such limitations, and provide additional operational benefits. For example, in some embodiments, a lens antenna may be used to create spatially defined sectors of coverage. Using such multibeam antennas, signal coverage may be provided to users by combining multiple feeds using the signal processing techniques described herein. In some embodiments, a graded index lens may be used to generate or receive the multiple beam of coverage.

These, and other features, are described in detail in the present document. For the sake of clarity, the description refers to the use of various antenna configurations for signal transmission purposes. However, it will be recognized by one of skill in the art that such antennas will also be able to receive signals using the multi-beam technology as described.

Figure 1:
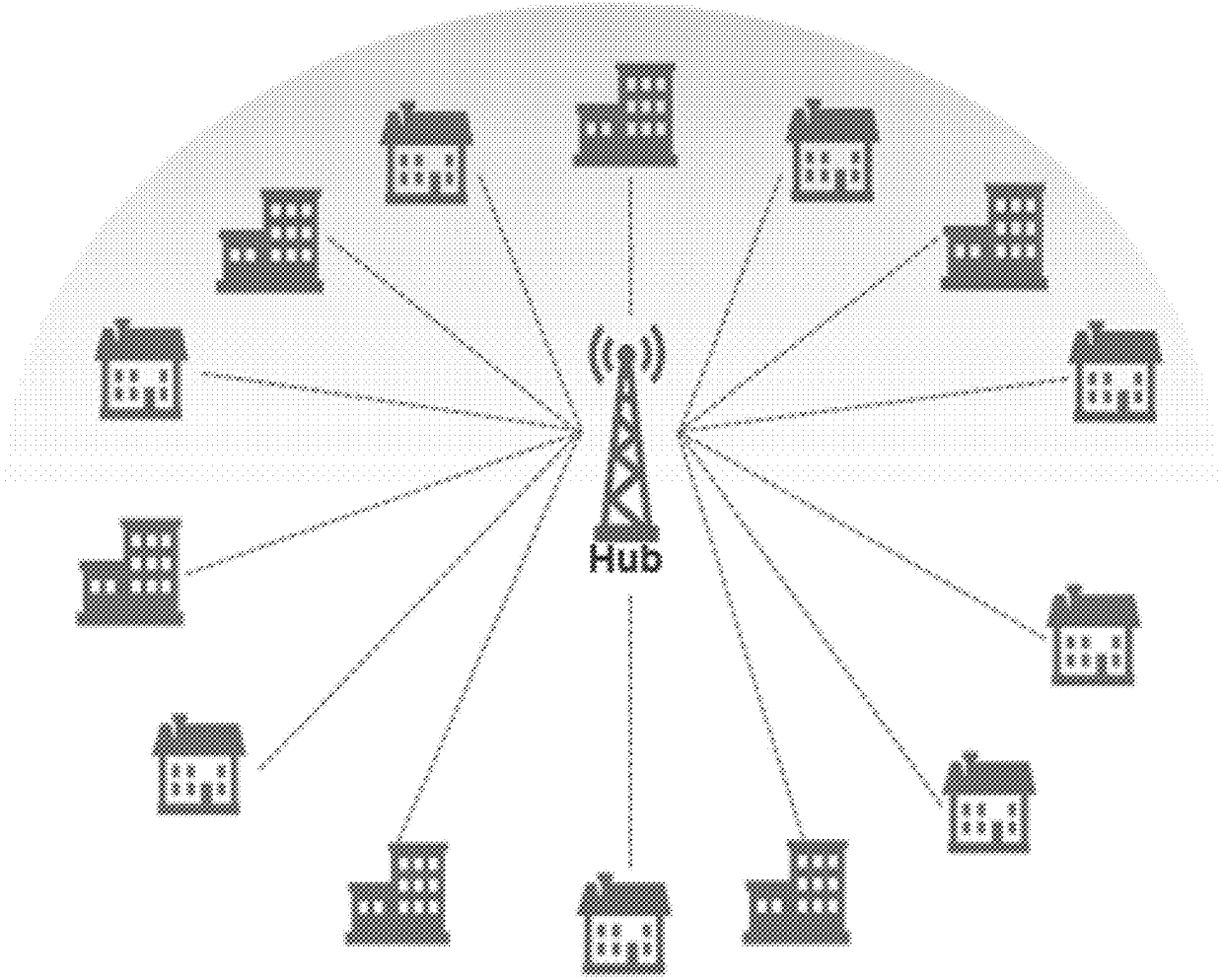
FIG. 1 shows an example of a fixed wireless access system.

FIG. 1 shows an example of a fixed wireless access system. A hub, that includes a transmission facility such as a cell tower, is configured to send and receive transmissions to/from multiple locations. For example, the locations could be user premises or business buildings. As described throughout this document, the disclosed techniques can achieve very high cell capacity fixed wireless access, when compared to traditional fixed access technology.

Figure 2:
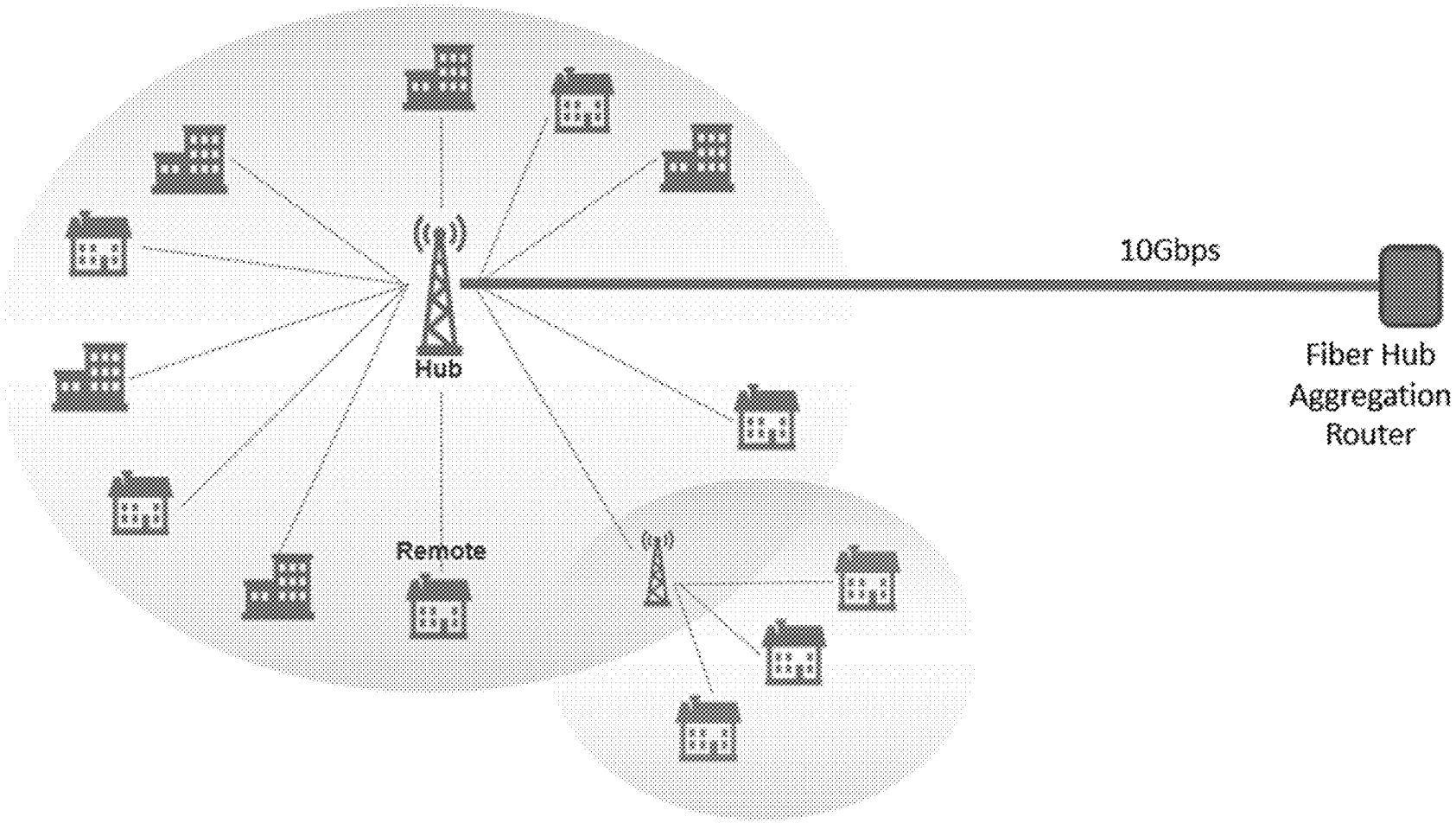
FIG. 2 shows yet another configuration of a fixed wireless access system.

FIG. 2 shows yet another configuration of a fixed access wireless communication system in which hops are used to reach users. For example, one cell tower may transmit/receive from another cell tower, which would then relay the transmissions between the principle cell tower and the users, thus extending range of the fixed wireless access system. A backhaul may connect the transmission tower with an aggregation router. For example, in one configuration, a 10 Gbps fiber connection may be used to feed data between a base station at a hub and a fiber hub aggregation router. In one advantageous aspect, deployment of this technology can be achieved without having to change any network bandwidth characteristics for harder to reach areas by using the hub/home access point (AP) configuration as a launch point.

Figure 3:
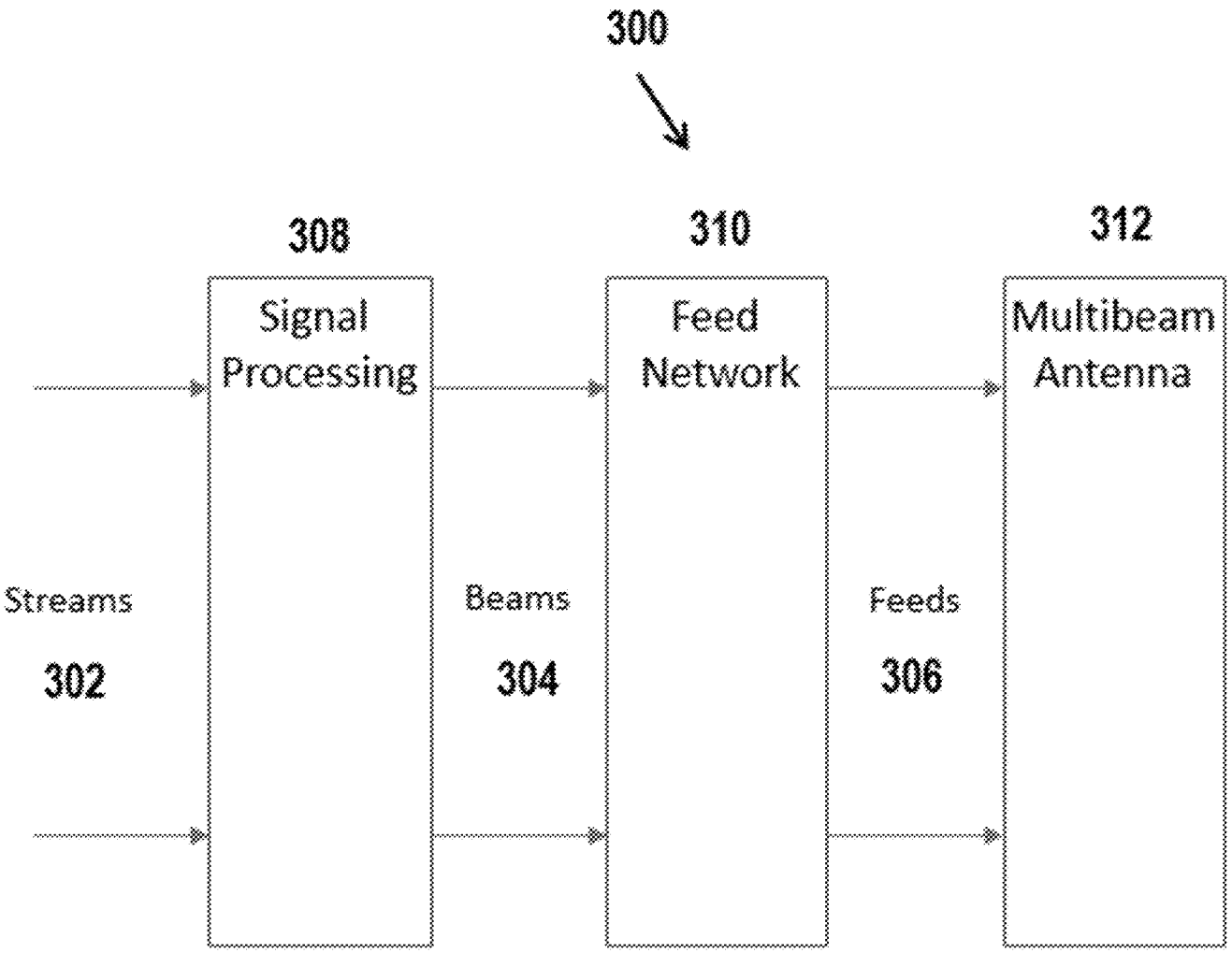
FIG. 3 shows an example workflow for using multi-beam antennas.

FIG. 3 shows an example workflow 300 for using multibeam antennas. For transmission, multiple streams 302, representing data to be transmitted, may be converted using signal processing 308 into multiple beams 304 that are fed to a feed network 310. The output feeds from the feed network 310 are fed to multiple feeds 306, into a multibeam antenna 312. Thus, multiple spatial beams of transmission or reception may be formed and changed according to network conditions by using a combination of one or more of stream processing and constructive or destructive contributions from individual antenna elements, as is further described throughout the document. In doing so, the signal processing 308 may be used to control the phases of signal fed into the antenna, the feed network 310 may be controlled to use particular antenna elements in an array of antenna elements and the multibeam antenna 312 may be used to control the beam orientation towards a target far-end device (e.g., a user equipment) for transmission or reception of signals.

Figure 4:
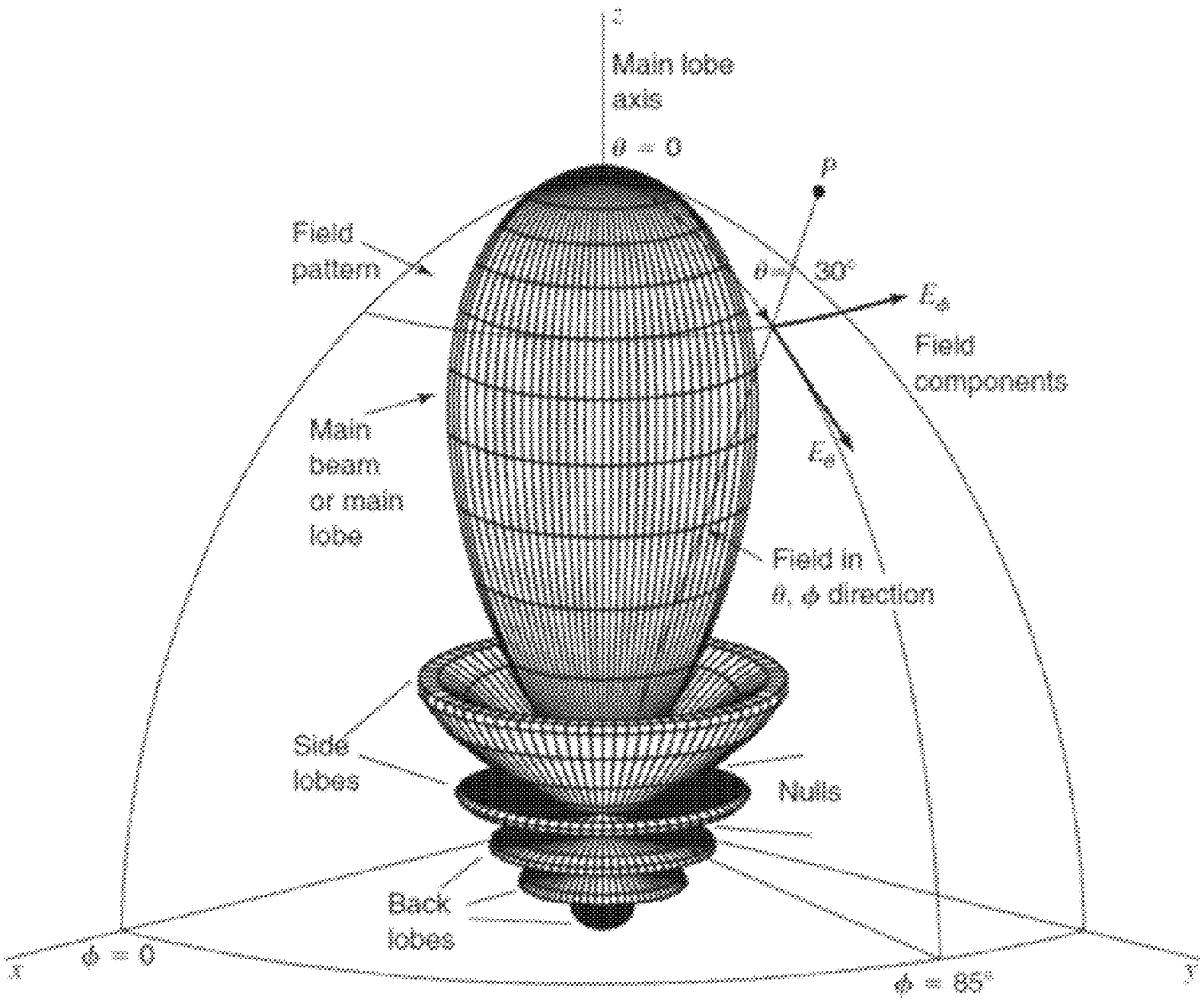
FIG. 4 shows an example of an antenna radiation pattern.

FIG. 4 shows an example of an antenna radiation pattern. As depicted, antenna beam from single antenna elements are often shaped to have a main lobe that is the primary direction in which data communication occurs.

Figure 5:
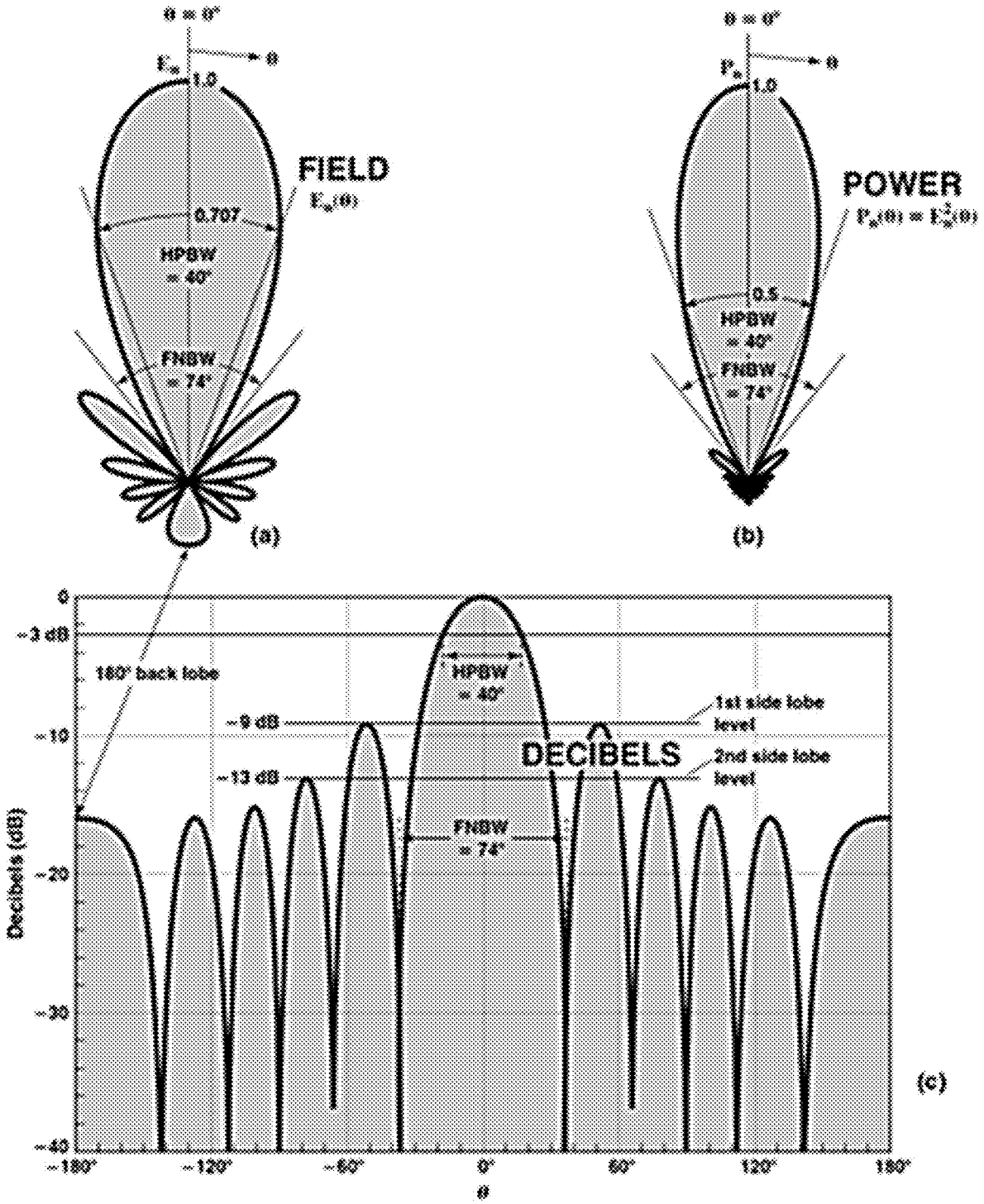
FIG. 5 shows another example of an antenna radiation pattern.

FIG. 5 shows another example of an antenna radiation pattern. In the depicted example, the gain of the main lobe is about 9 dB above the first side lobe and 13 dB above the second side lobe. The half power bandwidth (HPBW) is spread over a 40 degree angle and first null beam width (FNBW is about 74 degrees in this example.

FIG. 6 shows examples of parameters relevant to the calculation of antenna gain. Antenna gain is often defined as the ration of the radiation intensity in a given direction to the radiation intensity averaged over all directions. The gain of an antenna with losses is given by:

$$G = \frac{4\pi\eta A}{\lambda^2} \quad \text{Eq. (1)}$$

Where η=Efficiency,

A=Physical Aperture Area; and

λ=Wavelength.

Gain may be calculated as:

$$G = \frac{X\eta}{BW_\theta BW_\varphi} \quad \text{Eq. (2)}$$

Where BWθ,φ are elevation and azimuth beamwidths in degrees, X=41253 ηtypical=0.7 (rectangle approximation), and X=52525 ηtypical=0.55 (ellipsoid approximation).

Gain of an isotropic antenna radiating in a uniform spherical pattern is one (0 dB).

An antenna with a 20 degree beamwidth has a 20 dB gain. The 3 dB beamwidth is approximately equal to the angle from the peak of the power to the first null.

Antenna Efficiency-η, is a factor which includes all reductions from the maximum gain (Illumination efficiency, Phase error loss, Spillover loss, Mismatch (VSWR) loss, RF losses, etc. . . . )

Figure 7:
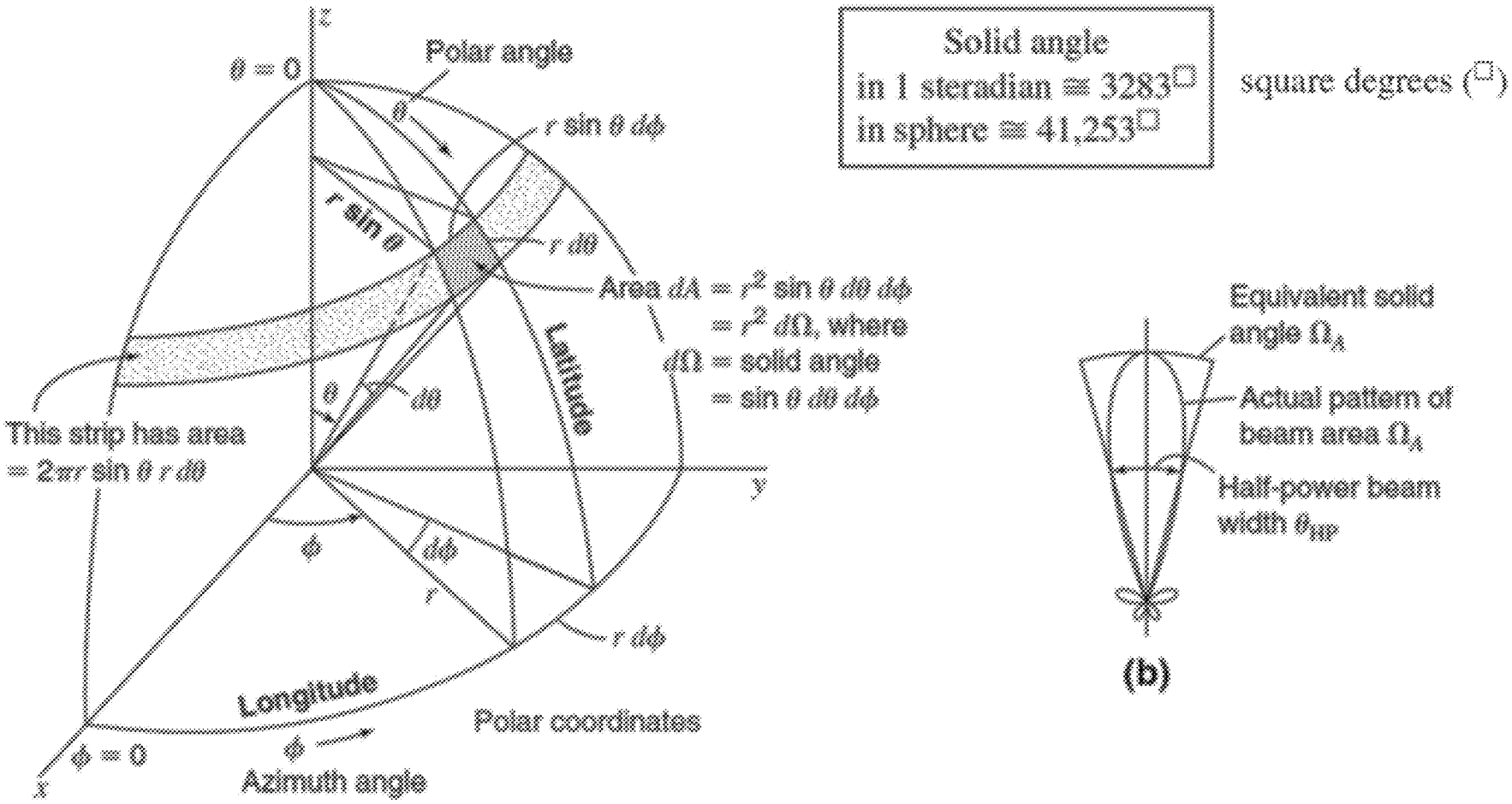
FIG. 7 shows a representation example of antenna radiation in polar coordinates.

FIG. 7 shows a representation example of antenna radiation in polar coordinates, along with definitions of certain measures of directivity or spatial characteristics of the antenna measured as half-power beam width and an equivalent solid angle.

FIG. 8 depicts an example of parametric representation of an antenna beam. The elliptical and the rectangular cross-sections show two different geometrical techniques of representing spatial characteristics of antenna beams.

With reference to the radiation pattern 802, the following equations can be seen. Area of ellipse in FIG. 8=πab=π[r sin(θ)/2][r sin(φ)/2]

$$G = \frac{\text{Area of Sphere}}{\text{Area of Antenna Pattern}} = \frac{16}{\sin(\theta)\sin(\varphi)} \quad \text{Eq. (3)}$$

$$G = \frac{16}{\sin(\theta)\sin(\varphi)} \approx \frac{16}{\theta\varphi\ [\text{radians}]} = \frac{52525}{BW_\theta BW_\varphi} \quad \text{Eq. (4)}$$

Where θ=BWθφ=BWφ.

Referring to FIG. 8, $$G = \frac{\text{Area of Sphere}}{\text{Area of Antenna Pattern}} = \frac{4\pi}{\sin(\theta)\sin(\varphi)} \quad \text{Eq. (5)}$$

Furthermore, $$G = \frac{4\pi}{\sin(\theta)\sin(\varphi)} \approx \frac{4\pi}{\theta\varphi\ [\text{radians}]} = \frac{41253}{BW_\theta BW_\varphi} \quad \text{Eq. (6)}$$

Where Area of rectangle=a*b=[r sin(θ)][r sin(φ)].

Figure 9:
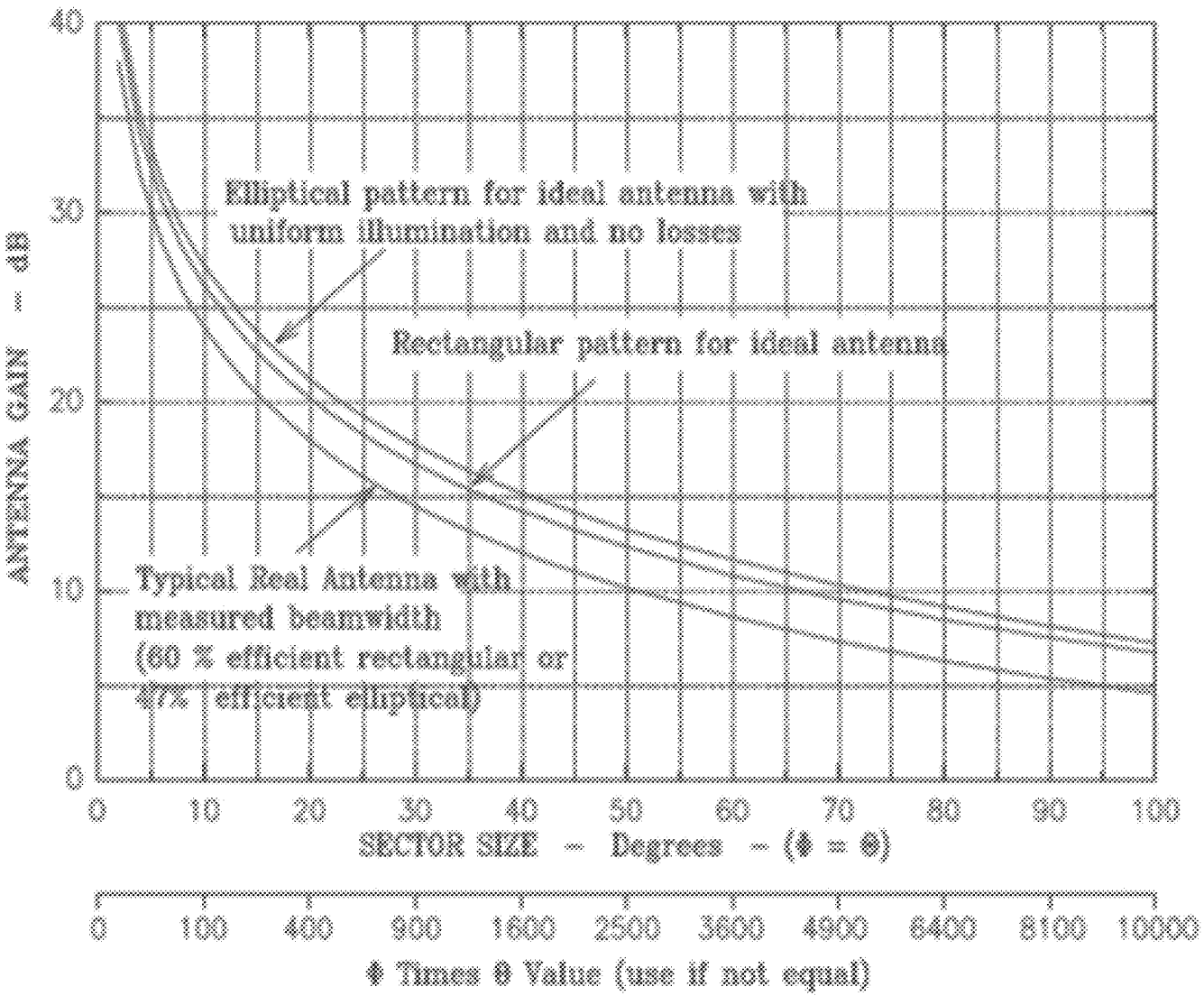
FIG. 9 is a graph showing an example of antenna gain as a function of sector size.

FIG. 9 is a graph showing an example of antenna gain as a function of sector size. The graph illustrates differences between elliptical pattern antenna and rectangular pattern antenna.

Figure 10:
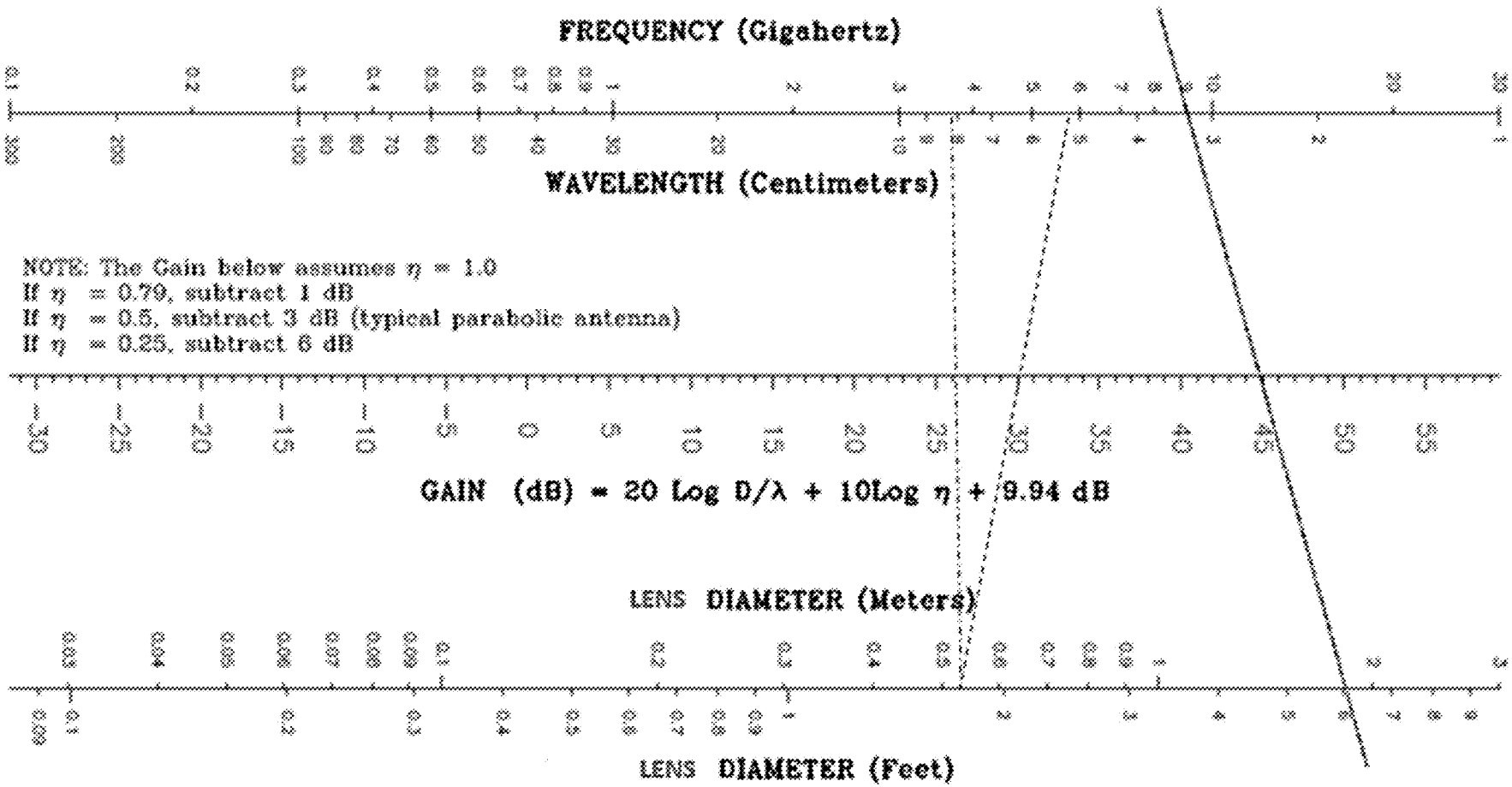
FIG. 10 shows examples of relationships between antenna frequency of operation and dimensions.

FIG. 10 shows examples of relationships between antenna frequency of operation and dimensions of antenna for the corresponding frequencies. As can be seen from this graph, optimal antenna size (e.g., length of linear elements) could be different for different for different operational frequencies. In particular, lens diameter between 0.5 and 0.6 meters may be suitable for 3 and 5 GHz operations of RF antennas, but have corresponding different gain values.

FIG. 11 depicts antenna source plane and observation plane examples. The variable U represents the amplitude and phase of the wave. The U1 can be expressed as:

$$U_1(\xi, \eta) = circ\left(\frac{\sqrt{\xi^2 + \eta^2}}{w}\right). \quad \text{Eq. (7)}$$

U2 can be expressed as:

$$U_2(x, y) = \frac{\exp(jkz)}{j\lambda z}\exp\left(j\frac{k}{2z}(x^2 + y^2)\right) \times w^2 \frac{J_1\left(2\pi\frac{w}{\lambda z}\sqrt{x^2 + y^2}\right)}{\frac{w}{\lambda z}\sqrt{x^2 + y^2}}. \quad \text{Eq. (8)}$$

I2 can be expressed as:

$$I_2(x, y) = \left(\frac{w^2}{\lambda z}\right)^2 \left[\frac{J_1\left(2\pi\frac{w}{\lambda z}\sqrt{x^2 + y^2}\right)}{\frac{w}{\lambda z}\sqrt{x^2 + y^2}}\right]^2. \quad \text{Eq. (9)}$$

The first zero in the pattern occurs when:

$$2\pi\frac{w}{\lambda z}x = 1.22\pi. \quad \text{Eq. (10)}$$

FIG. 12 shows examples of window functions. It may be noted that window functions can be used to concentrate passband signal energy to within a frequency. As such, windowing in the spatial domain can be used to shape the gain pattern of a beam to lie within certain spatial region, while suppressing gain outside of the beam area.

FIG. 13 shows graphs and equations for uniform rectangular and circular aperture antennas and corresponding spatial selectivity (directivity) that can be achieved.

Figure 14:
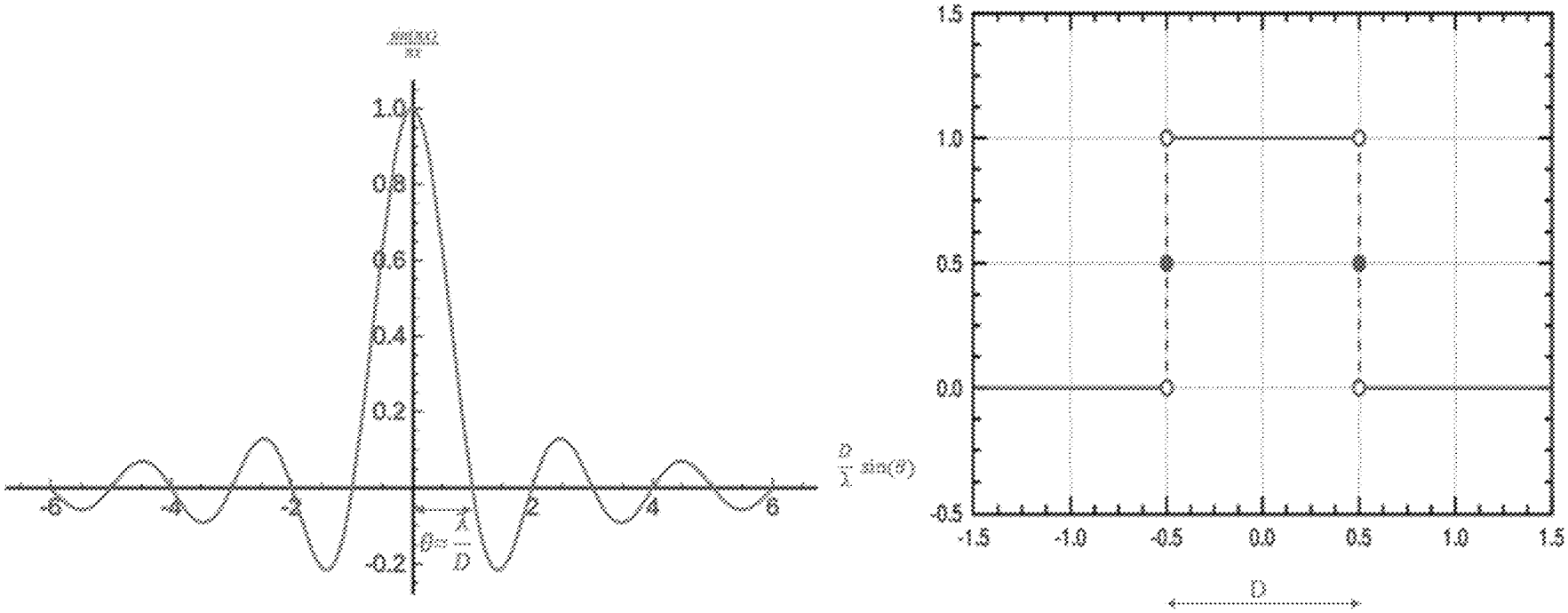
FIG. 14 shows an example of a sinc pulse and its transformed representation.

FIG. 14 shows an example of a sinc pulse and its transformed representation. In this example, Fourier transform is used for the transformation.

Figure 15:
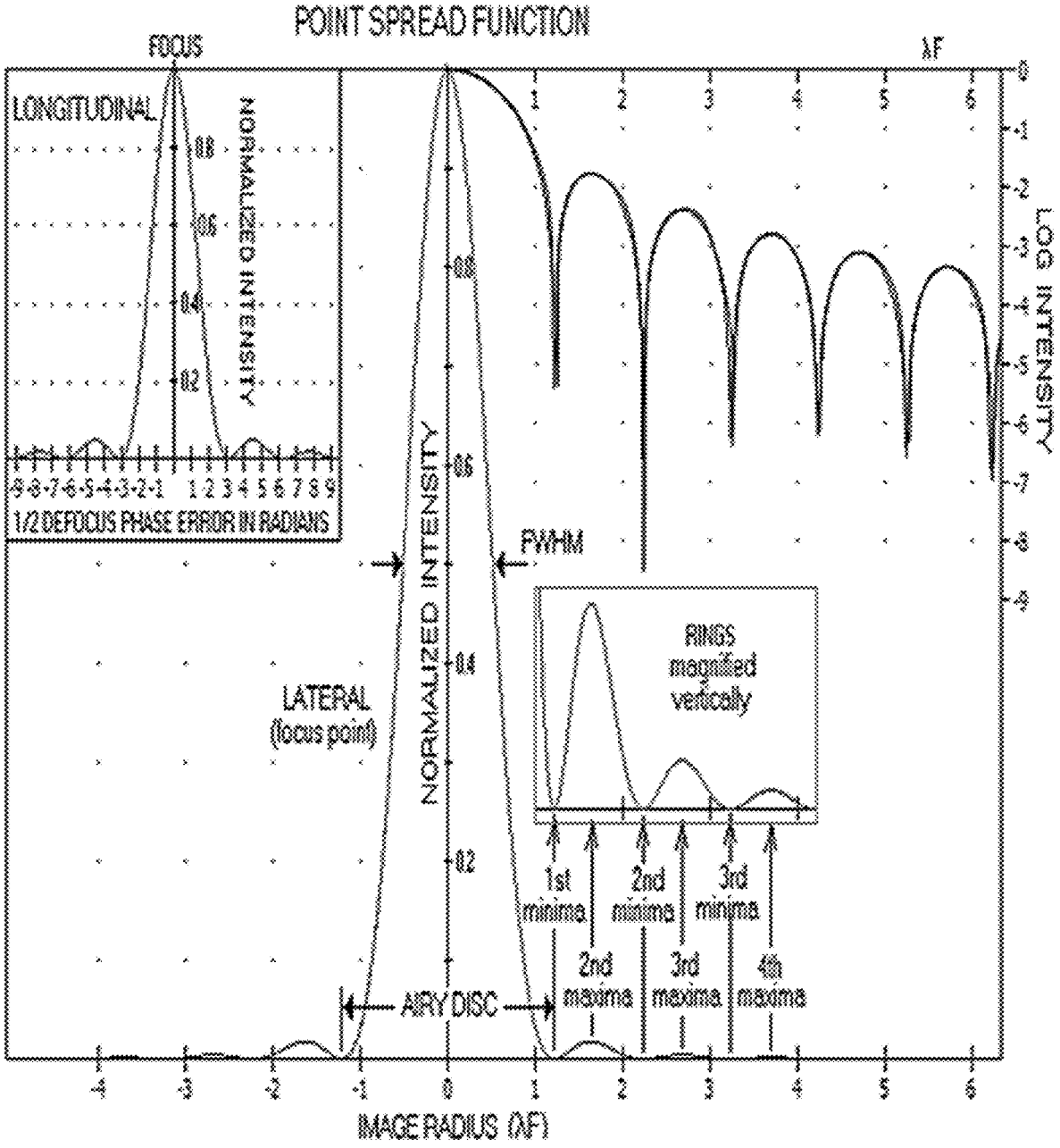
FIG. 15 depicts an example of a Jinc function.

FIG. 15 depicts an example of a Jinc function (which is a Bessel function similar to sinc function).

As further described in this document, the sinc and Jinc functions can be implemented to achieve windowing of antenna beams for spatial selectivity.

FIG. 16 shows an example of a power pattern for a circular aperture antenna. Such an antenna may also be used as an antenna element in the described embodiments.

Figure 17:
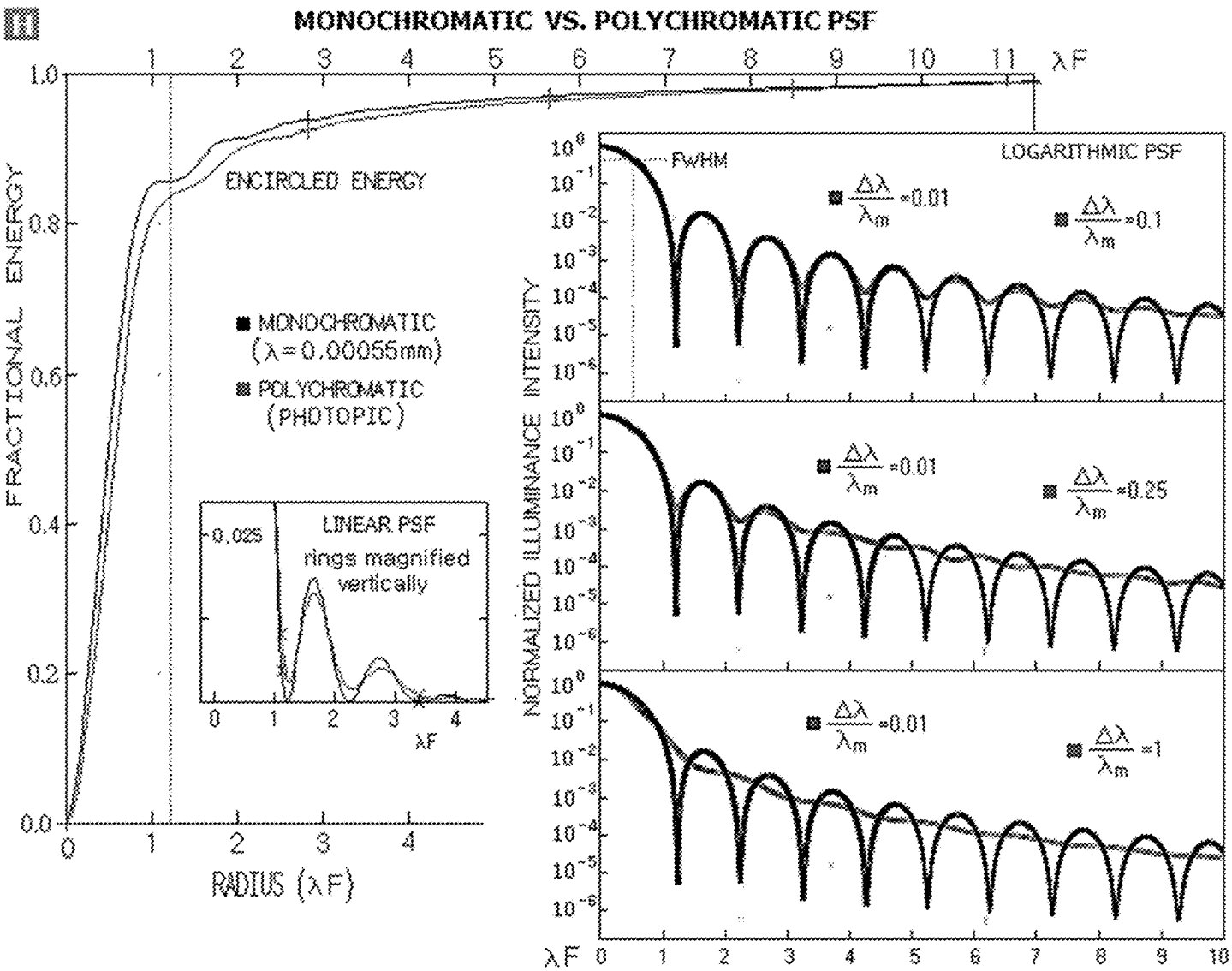
FIG. 17 shows examples of monochromatic and polychromatic point spread functions.

FIG. 17 shows examples of monochromatic and polychromatic point spread functions. These functions represent the beams formed by point antennas.

Figure 18:
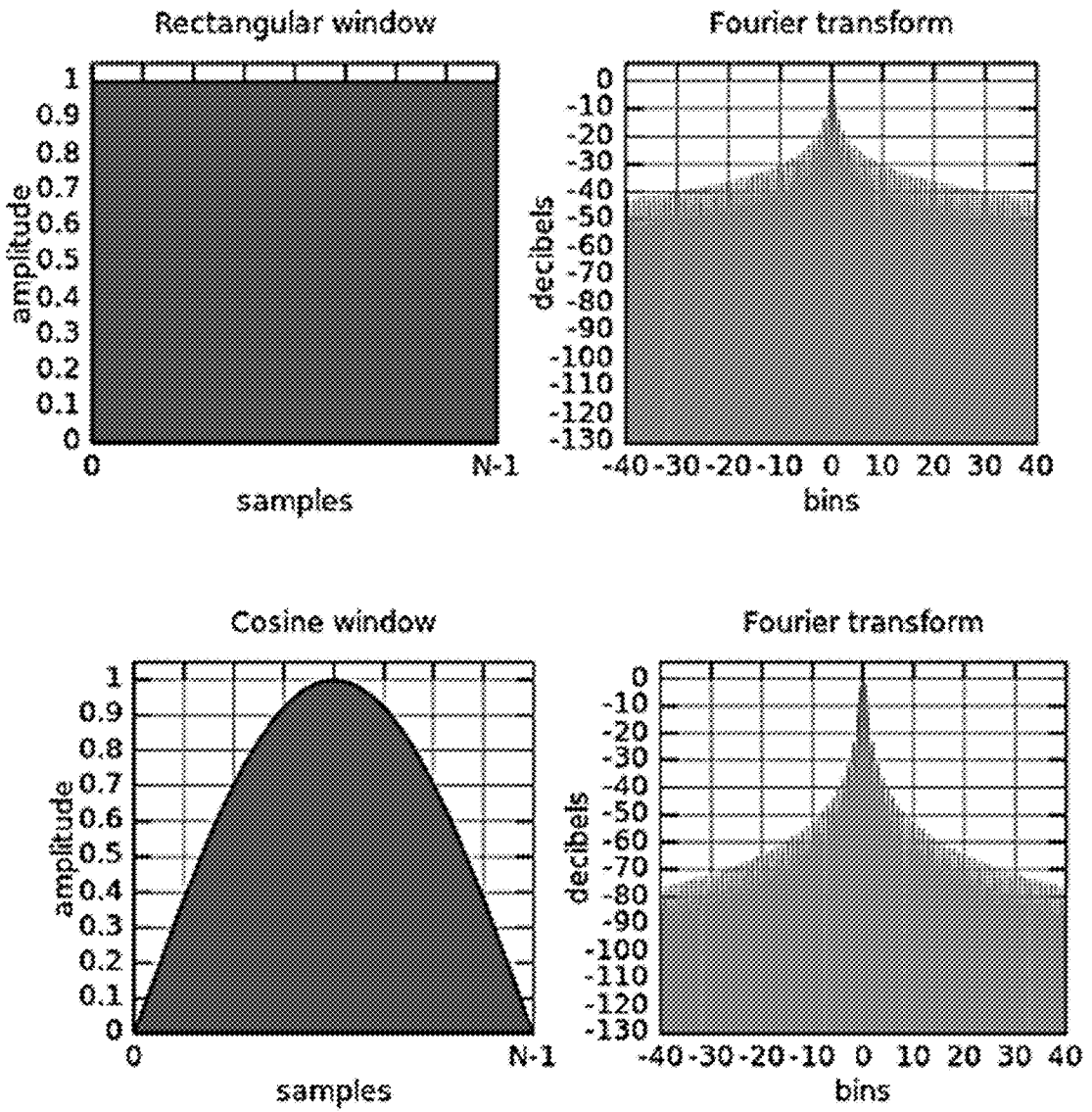
FIG. 18 shows examples of window functions.

FIG. 18 shows examples of window functions. It can be seen that, in comparison with the rectangular window function, a cosine window exhibits a transform domain spectrum that has a wider main lobe, but significantly lower side lobes, e.g., 30 dB or lower amplitude. Windowing using functions as depicted in FIG. 18 could be achieved by using linear weighted ums of signal streams in the arrangement as depicted in FIG. 3.

Figure 19:
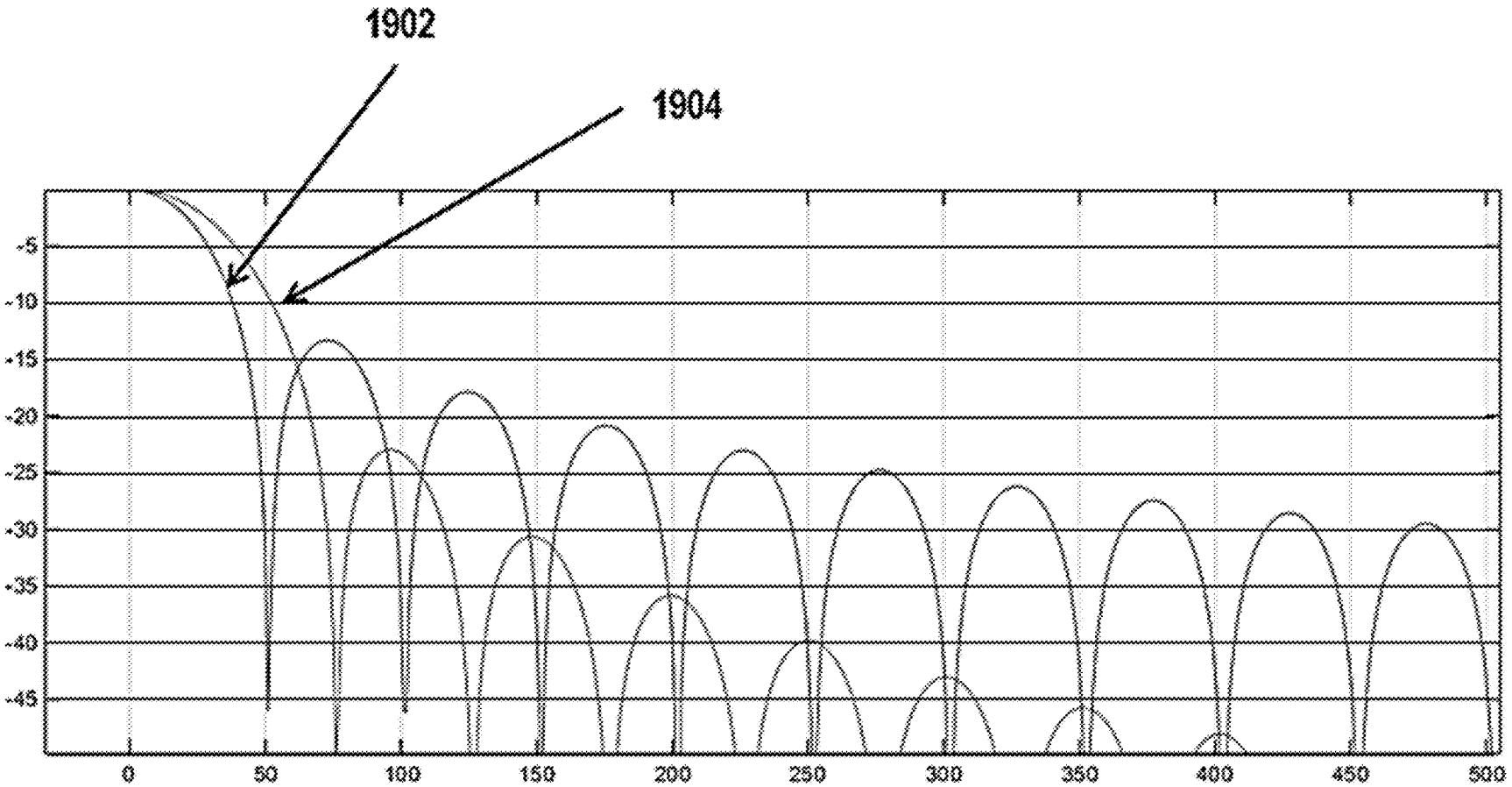
FIG. 19 shows examples of power cosine and window functions.

FIG. 19 shows examples of power cosine and uniform window functions. As can be seen from the graph, in comparison with uniform window (1902), a cosine window 1904 offers greater side lobe suppression at the expense of wider main lobe. In particular, while the first side lobe of the uniform window is around 13 dB, the first side lobe of the cosine window is down by almost 23 dB, with the remaining side lobes having at least 30 dB attenuation.

Figure 20:
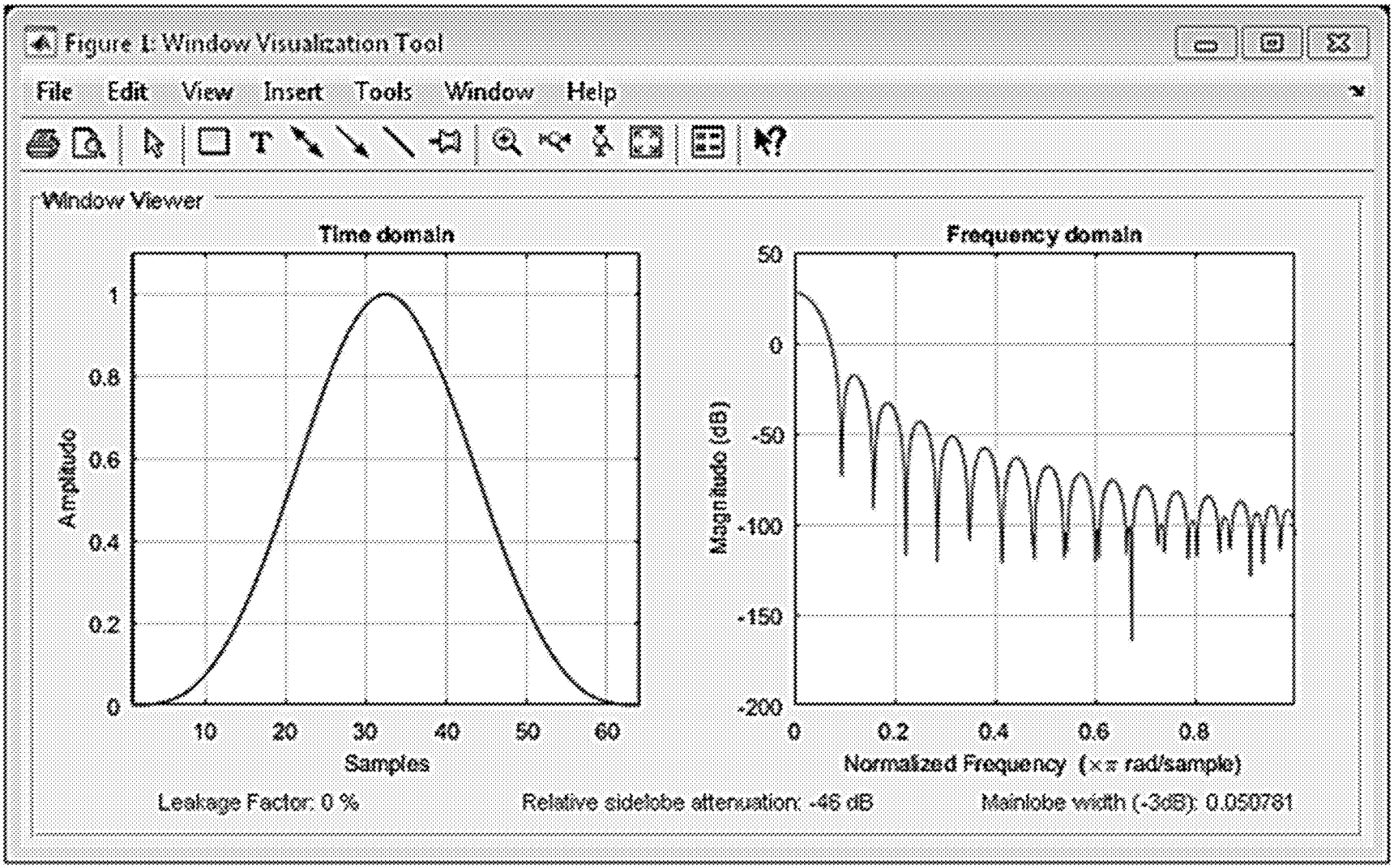
FIG. 20 shows an example of Bohman's window.

FIG. 20 shows an example of Bohman's window, which is obtained by convolution of a cosine window by itself.

Figure 21:
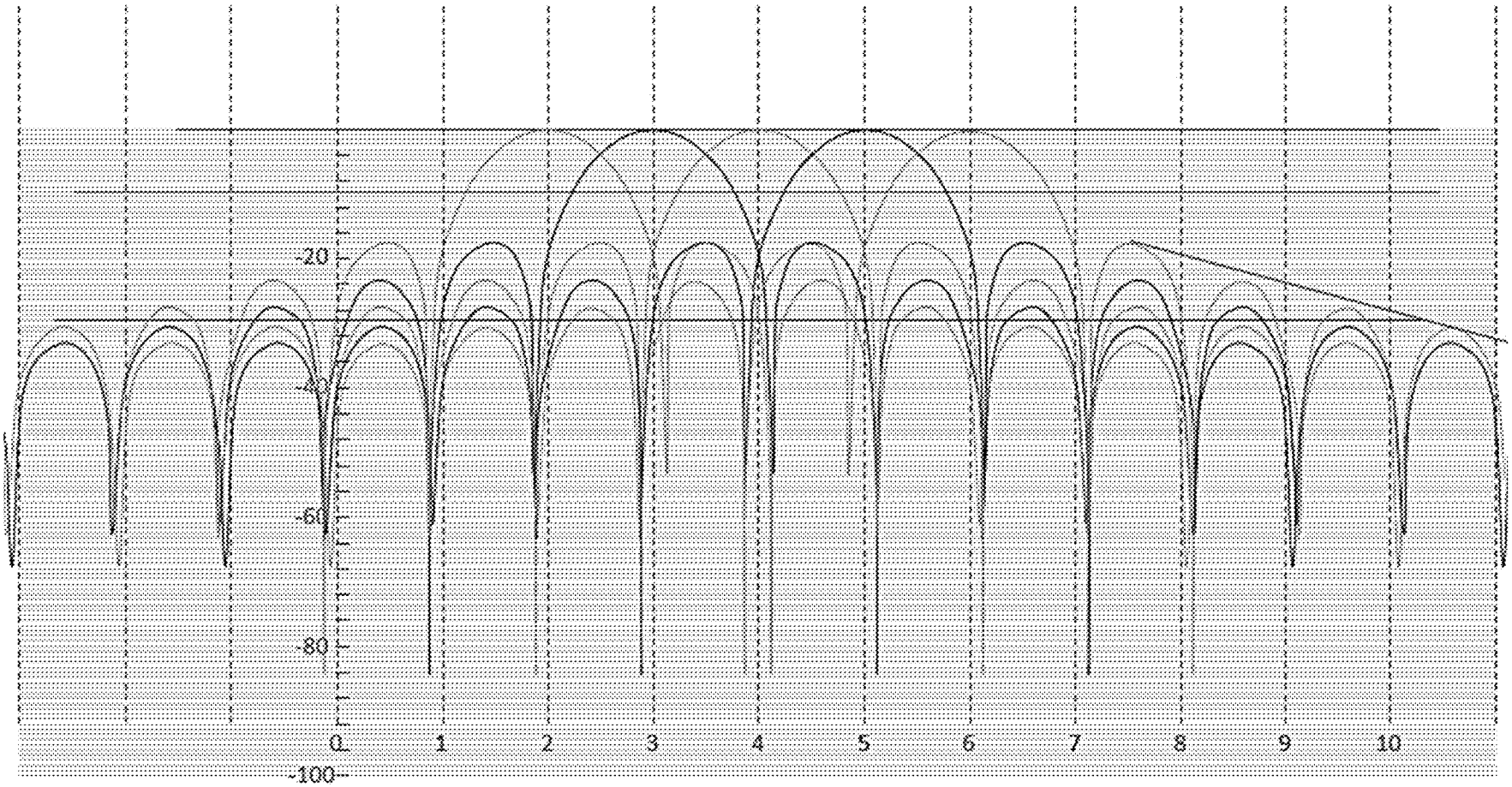
FIG. 21 shows an example of radiation pattern of a multibeam circular aperture antenna without windowing.
Figure 21:
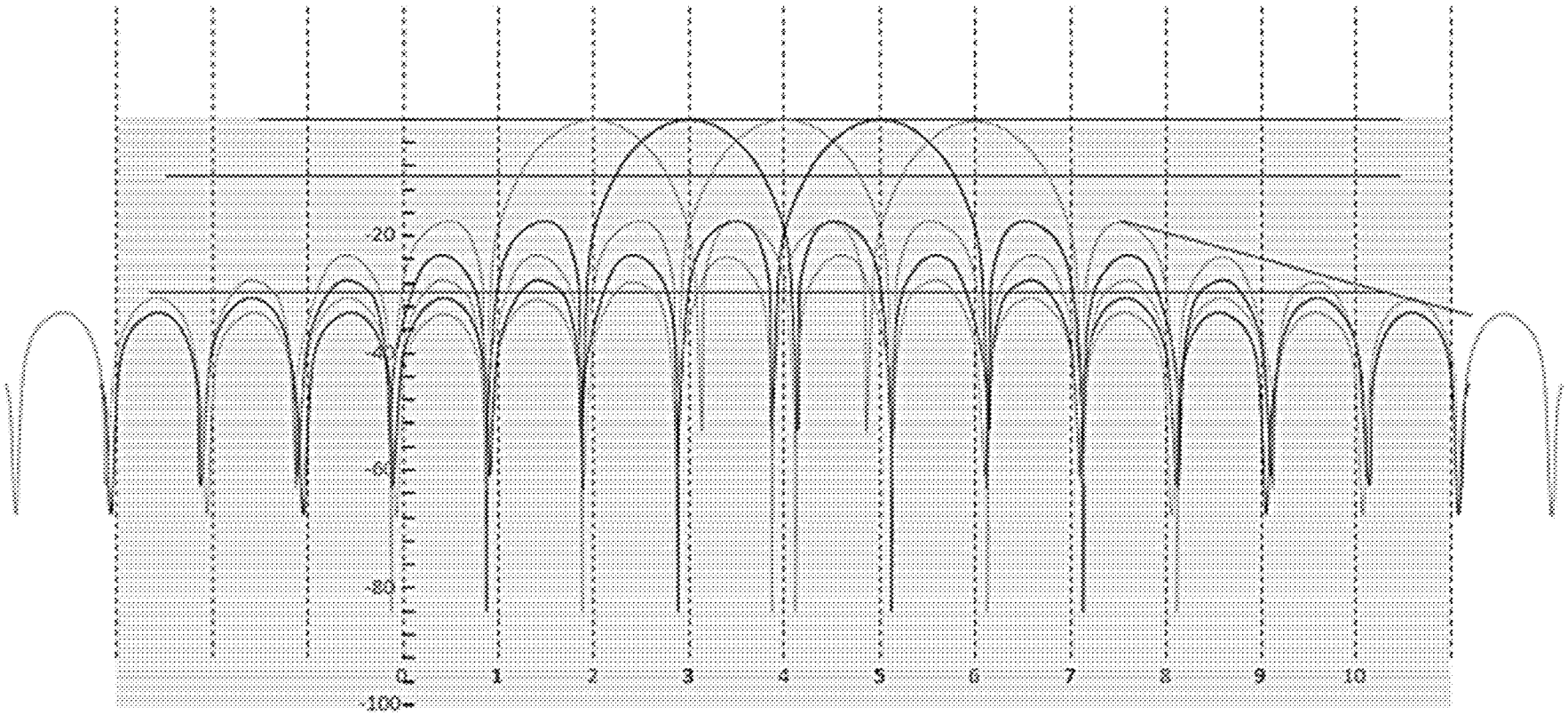

FIG. 21 shows an example of radiation pattern of a multibeam circular aperture antenna without windowing. Five main lobes, e.g., corresponding to 5 radiating elements, are depicted. No windowing is used in the depicted radiation pattern.

Figure 22:
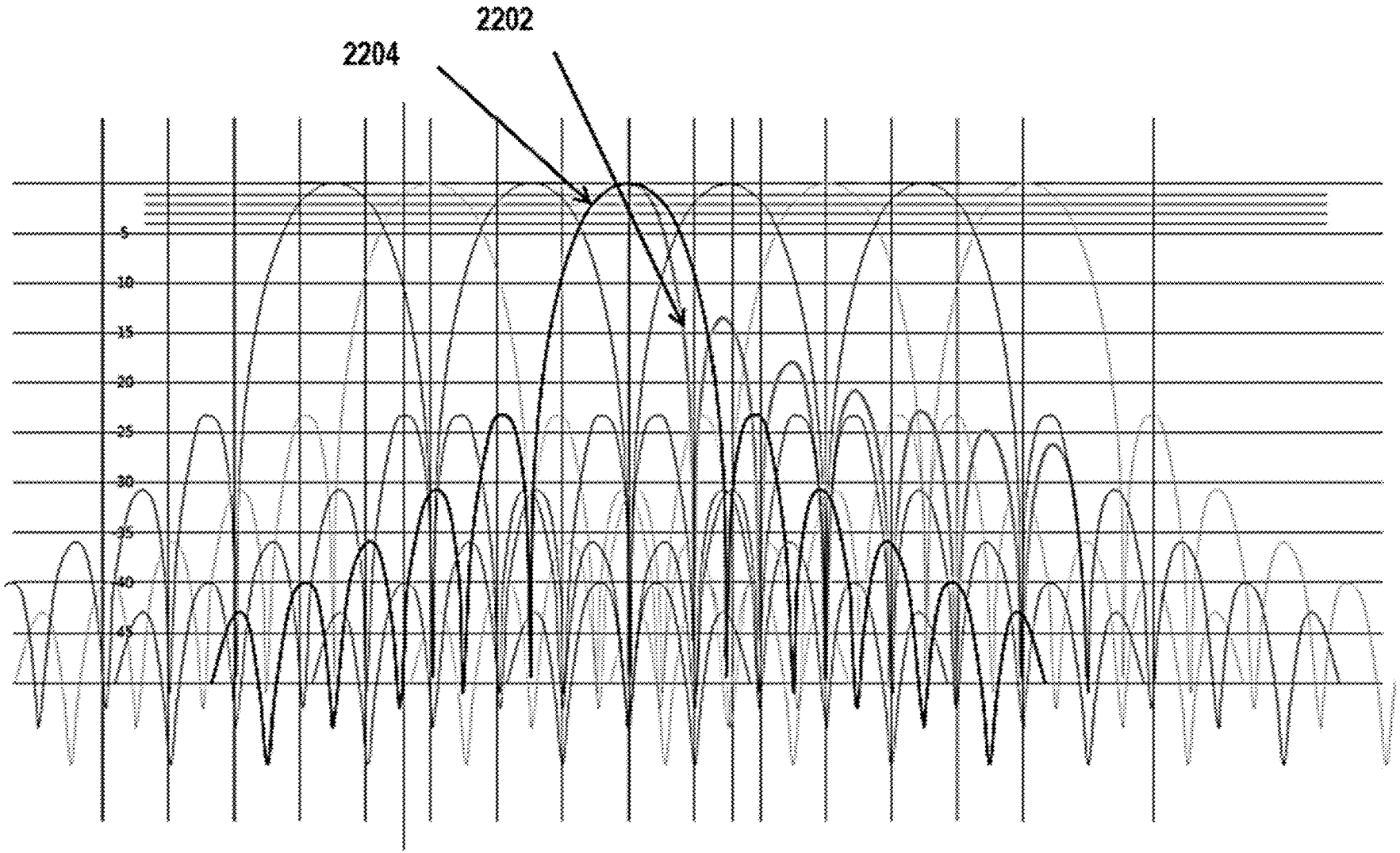
FIG. 22 shows an example of radiation pattern of a multibeam circular aperture antenna with cosine windowing.

FIG. 22 shows an example of radiation pattern of a multibeam circular aperture antenna with cosine windowing. The depicted embodiment shows eight main lobes corresponding to eight radiative elements. The curve 2202 represents an example of a sinx/x window. The curve 2204 represents an example of a cosine windowed beam, which, as a result of the windowing, has a wider beam and lower side lobes compared to the curve 2202. The x-axis represents beam angle and the Y axis represents radiative power in dB.

Figure 23:
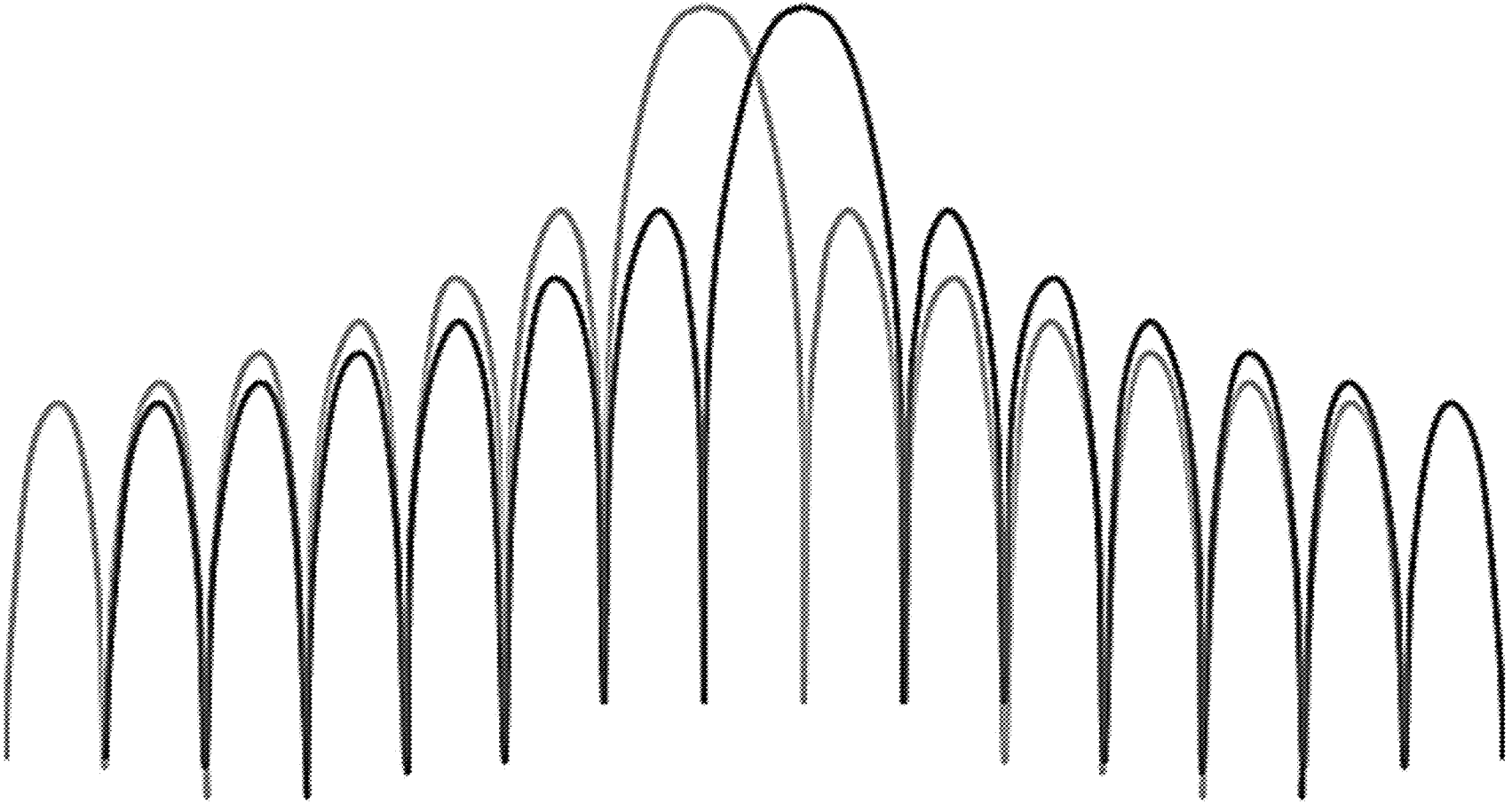
FIG. 23 shows two adjacent radiation lobes.

FIG. 23 shows two adjacent radiation lobes in a cosine windowed radiation pattern.

Figure 24:
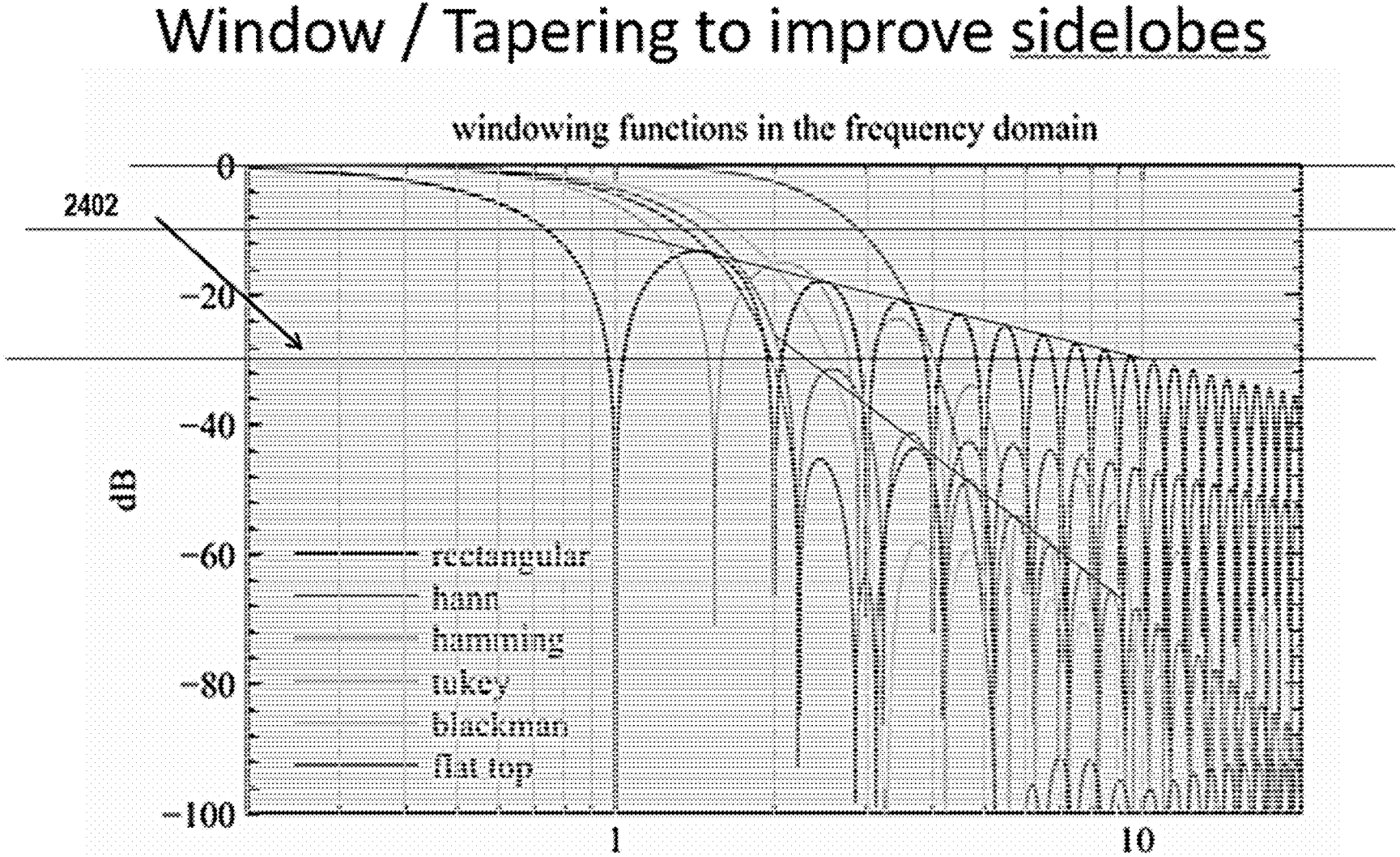
FIG. 24 pictorially depicts the use of windowing to shape radiation pattern.

FIG. 24 pictorially depicts the use of windowing to shape radiation pattern. The graph depicts relative frequency domain characteristics of six window functions: rectangular, Hann, Hamming, Tukey, Blackman and Flat top. FIG. 24 shows that there is a trade-off between the width of the main lobe, and how fast side lobes of the window function attenuate away from the main lobe. The slopes in the stopband indicate how much a given antenna beam will interfere with radiative patterns of neighboring antenna elements conforming to each window function. For example, roughly speaking, a rectangular window may have narrowest main lobe, but relatively low side lobe suppression, implying signal interference of neighboring antenna elements.

By contrast, a flat top window may have a relatively broad main lobe, but side lobes are attenuated below −80 dB, so that adjacent antenna elements will not radiate to interfere with each other. Thus, FIG. 24 shows a trade-off between spacing in antenna elements on an antenna and the implementation of a windowing function for the radiated beam such that, for that spacing, the resulting beams are relatively free of interference from each other. The horizontal line 2402 may represent a target side lobe attenuation for a given antenna configuration. This target attenuation may be based on a calculation related to the symbol complexity of QAM symbols being transmitted by the antenna. For example, high order QAM constellations such as 64 QAM and above may target at least 30 dB attenuation of sidebands to reduce interference from neighboring beams.

Figure 25:
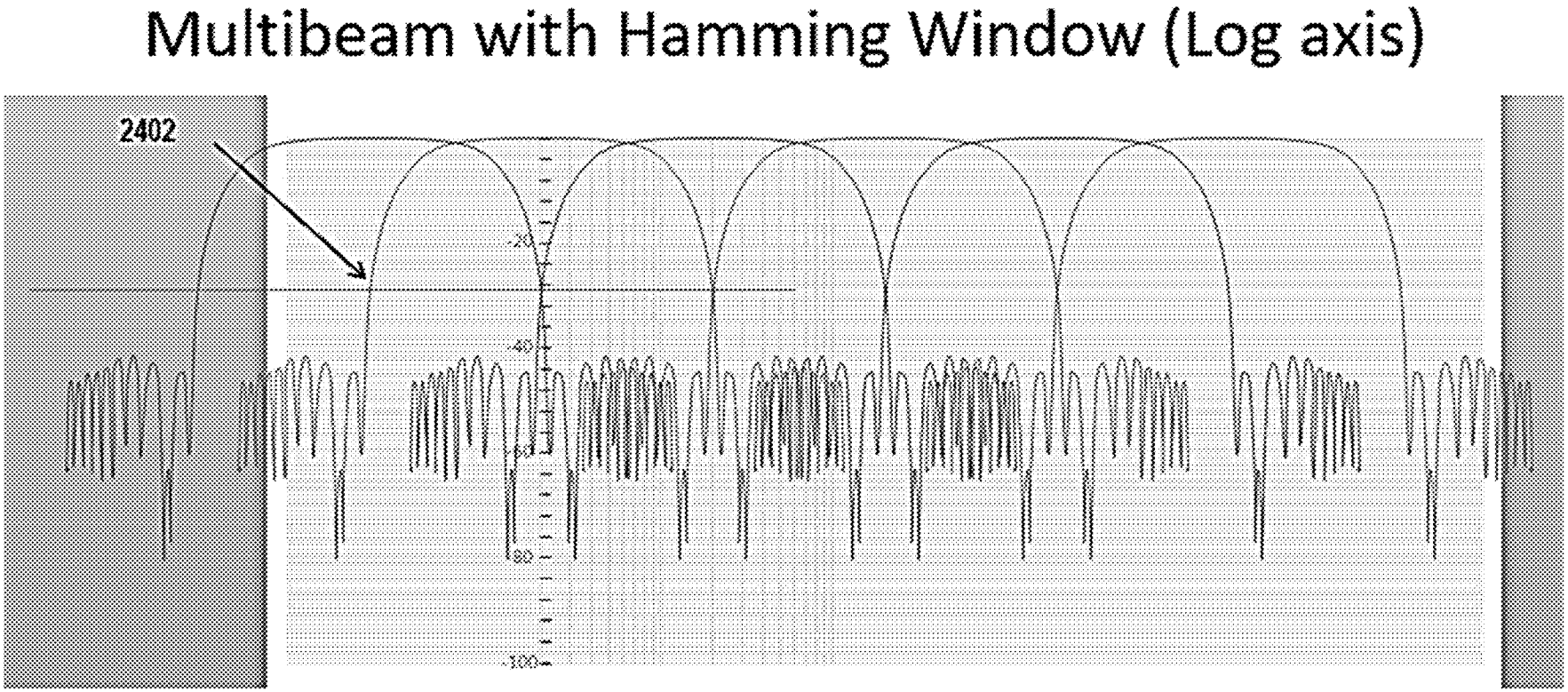
FIG. 25 shows a multibeam radiation pattern with Hamming window.

FIG. 25 shows a multibeam radiation pattern with Hamming window. The example shows six beams, with each beam having side lobes suppressed to at least −40 dB level, far below the target attenuation threshold shown by the horizontal line around −30 dB. While the beam patterns of adjacent lobes overlap, alternate lobes do not overlap and their amplitudes are down to the target attenuation level at the midway point between the alternate lobes.

Figure 26:
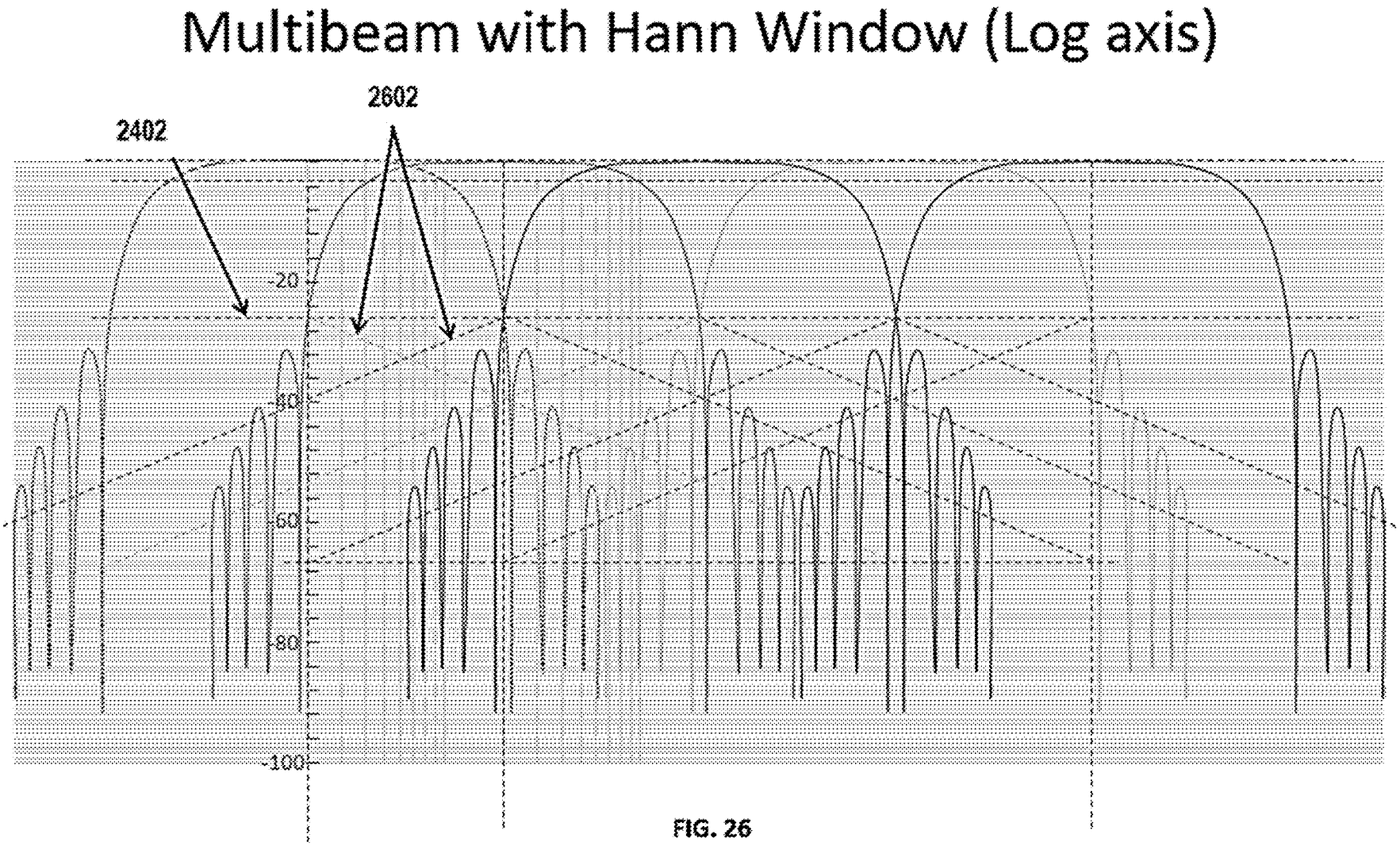
FIG. 26 shows a multibeam radiation pattern with Hann window.

FIG. 26 shows a multibeam radiation pattern with Hann window. The slopes 2602 represent the out-of-band attenuation achieved by beams shaped with the Hann window function.

Figure 27:
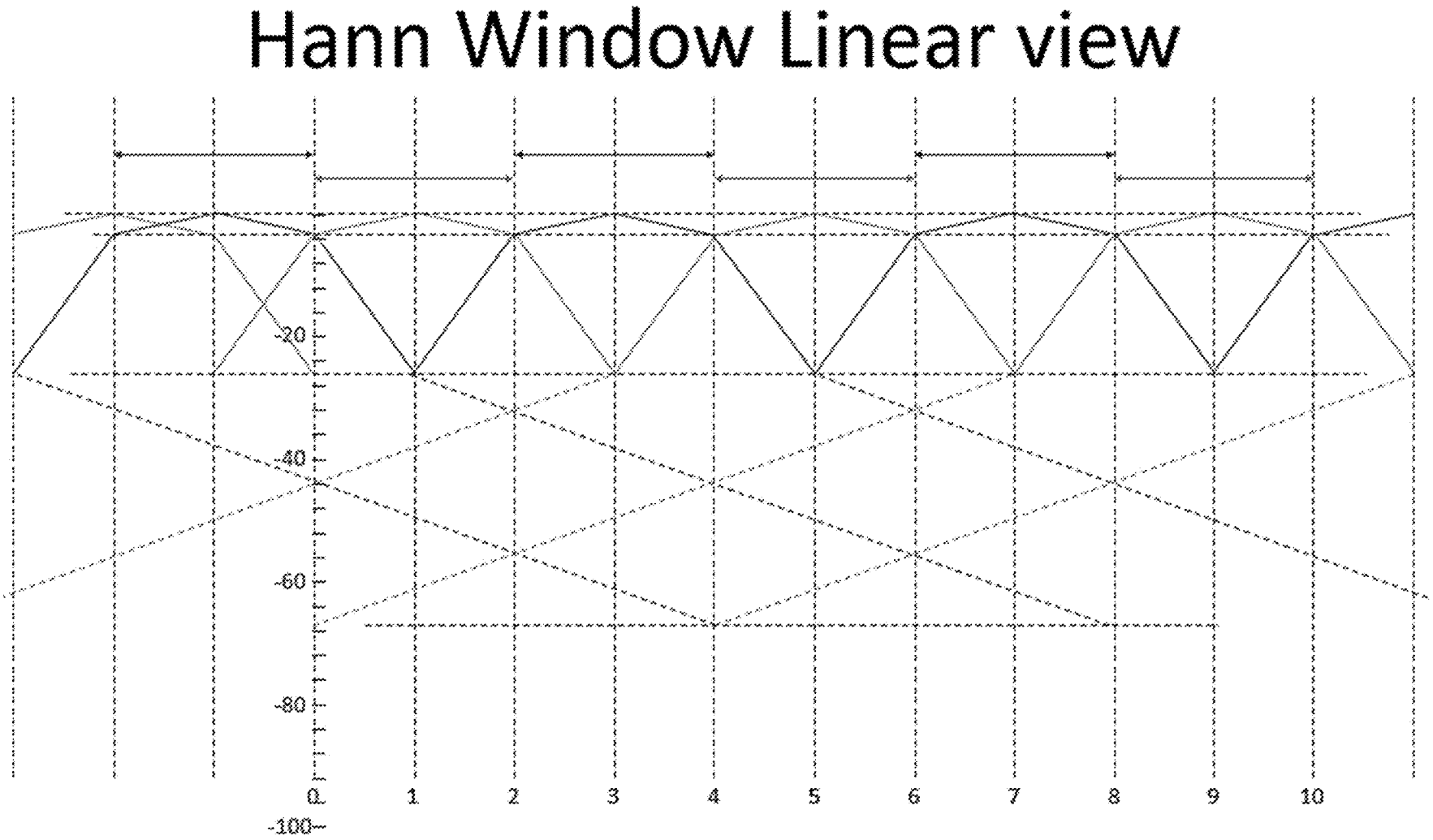
FIG. 27 shows a multibeam radiation example on linear scale.
Figure 28:
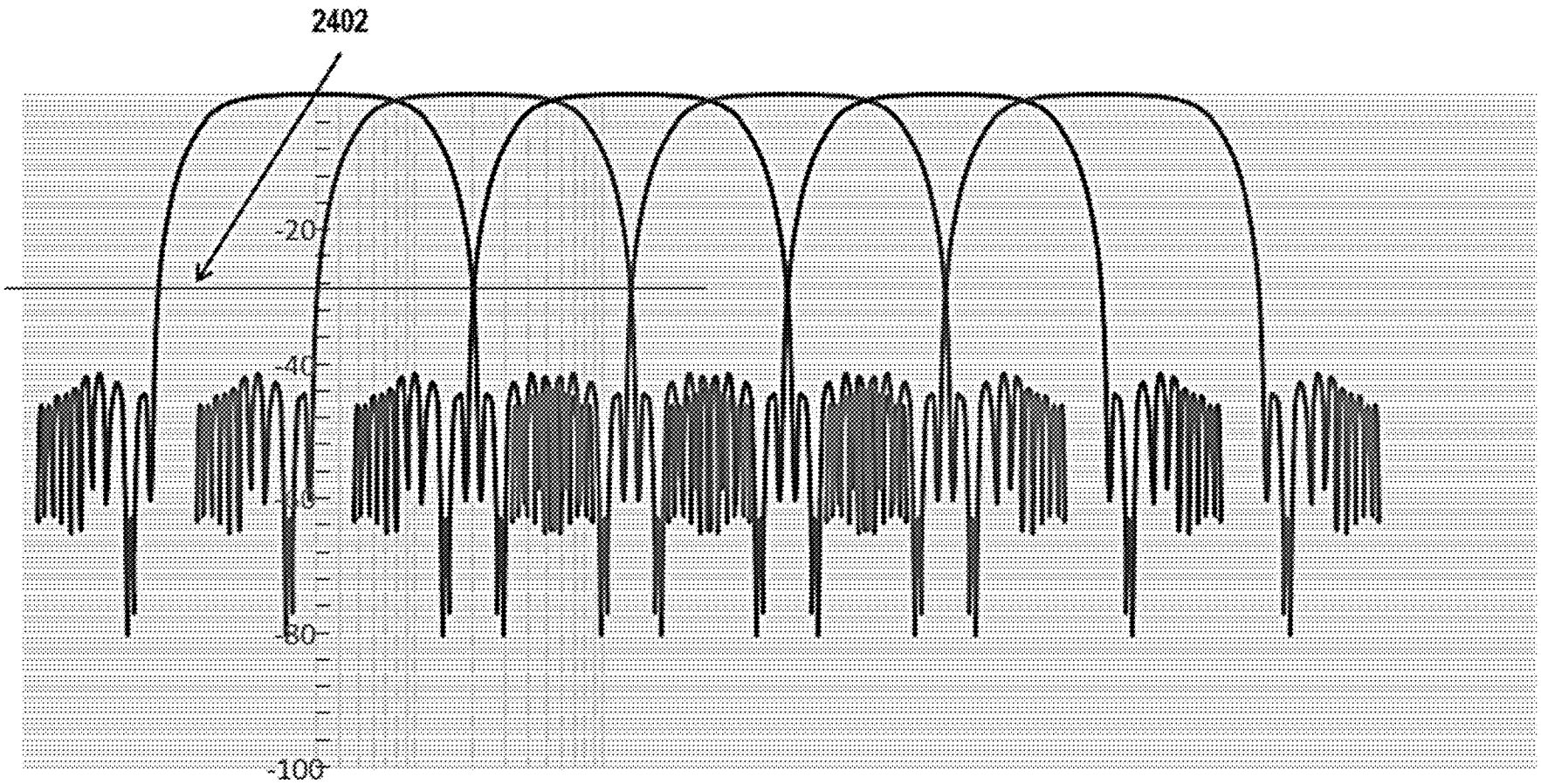
FIG. 28 shows a multibeam antenna pattern.
Figure 29:
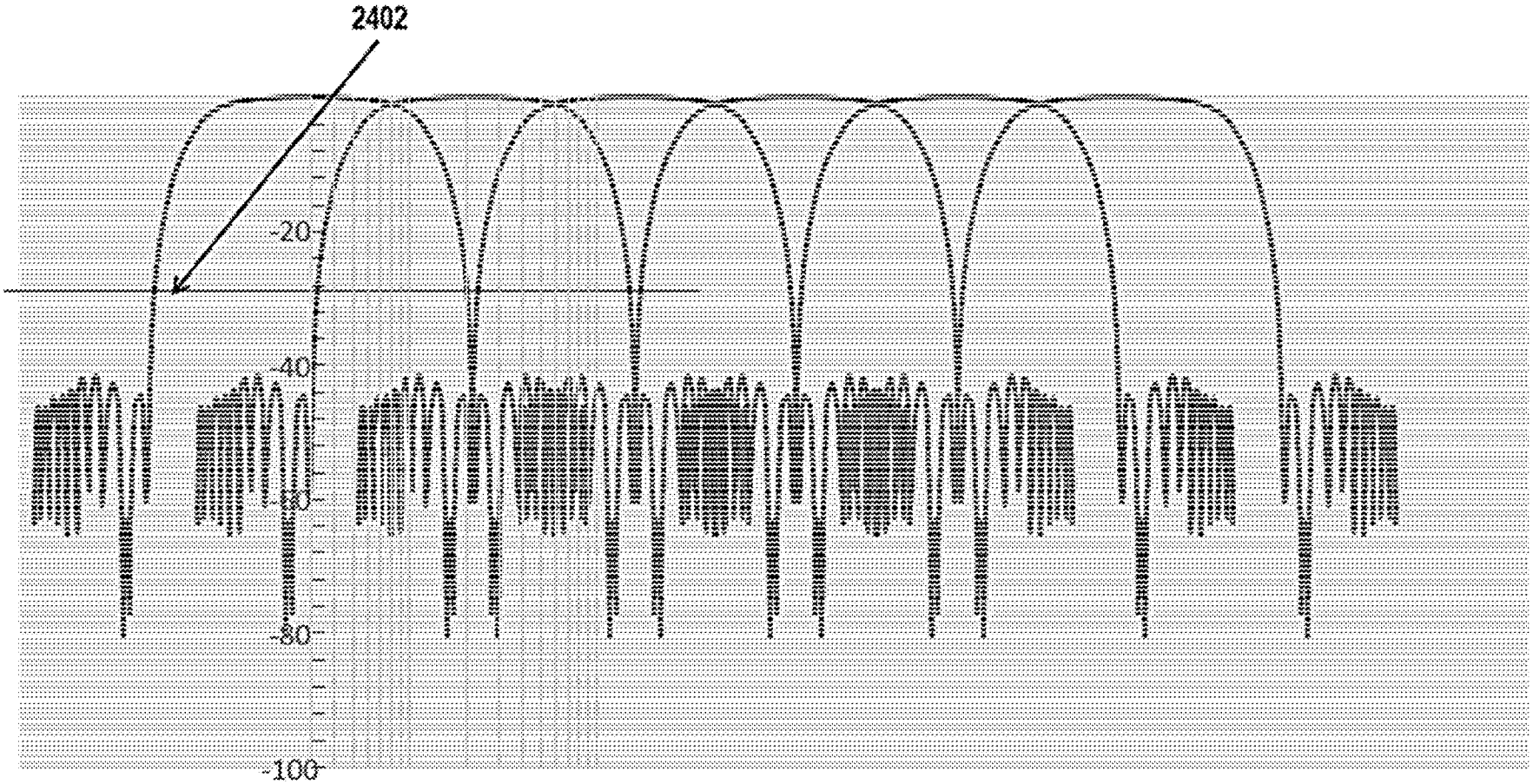
FIG. 29 shows another multibeam antenna pattern.
Figure 30:
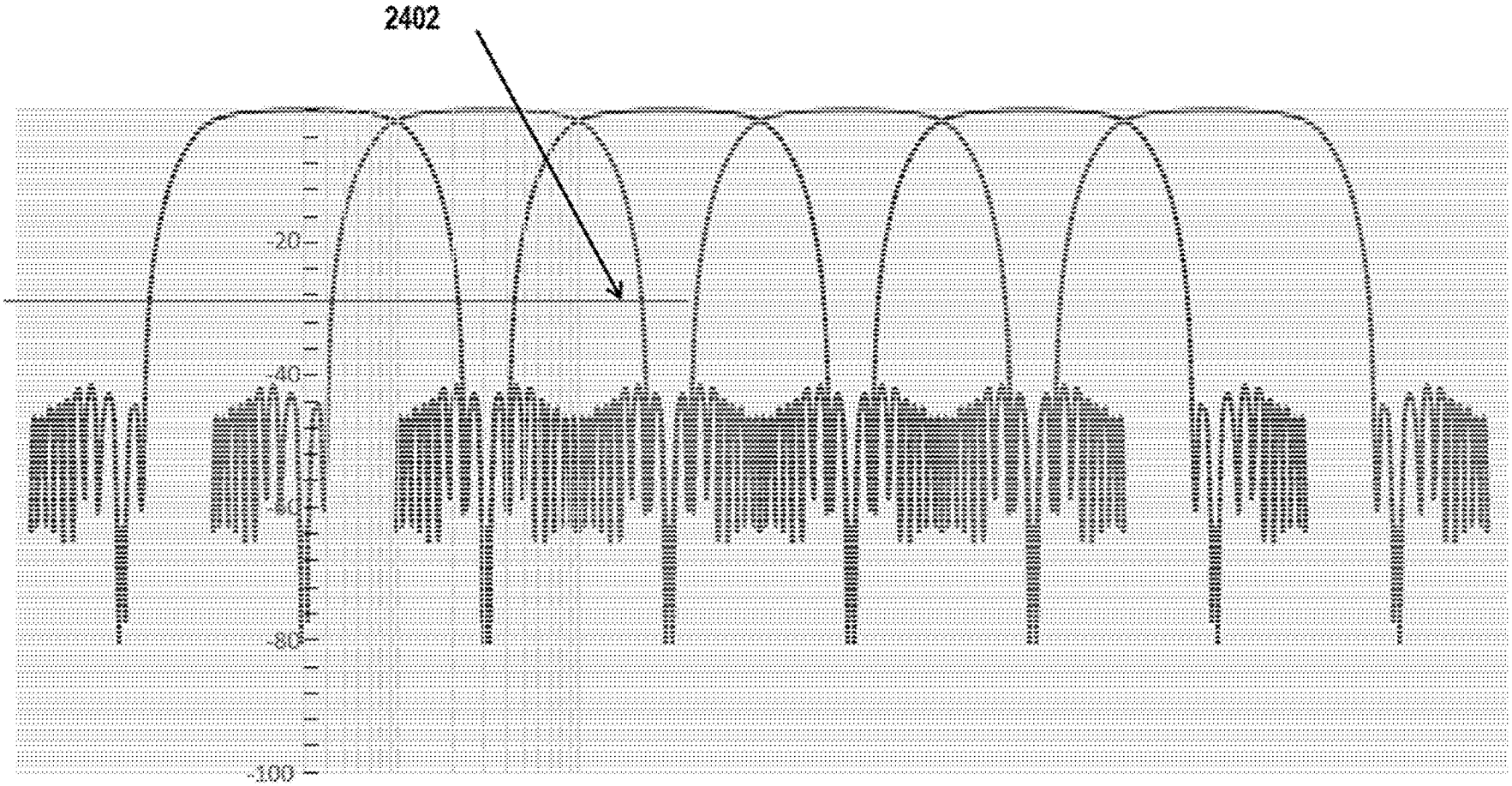
FIG. 30 shows another example of a multibeam antenna pattern.
Figure 31:
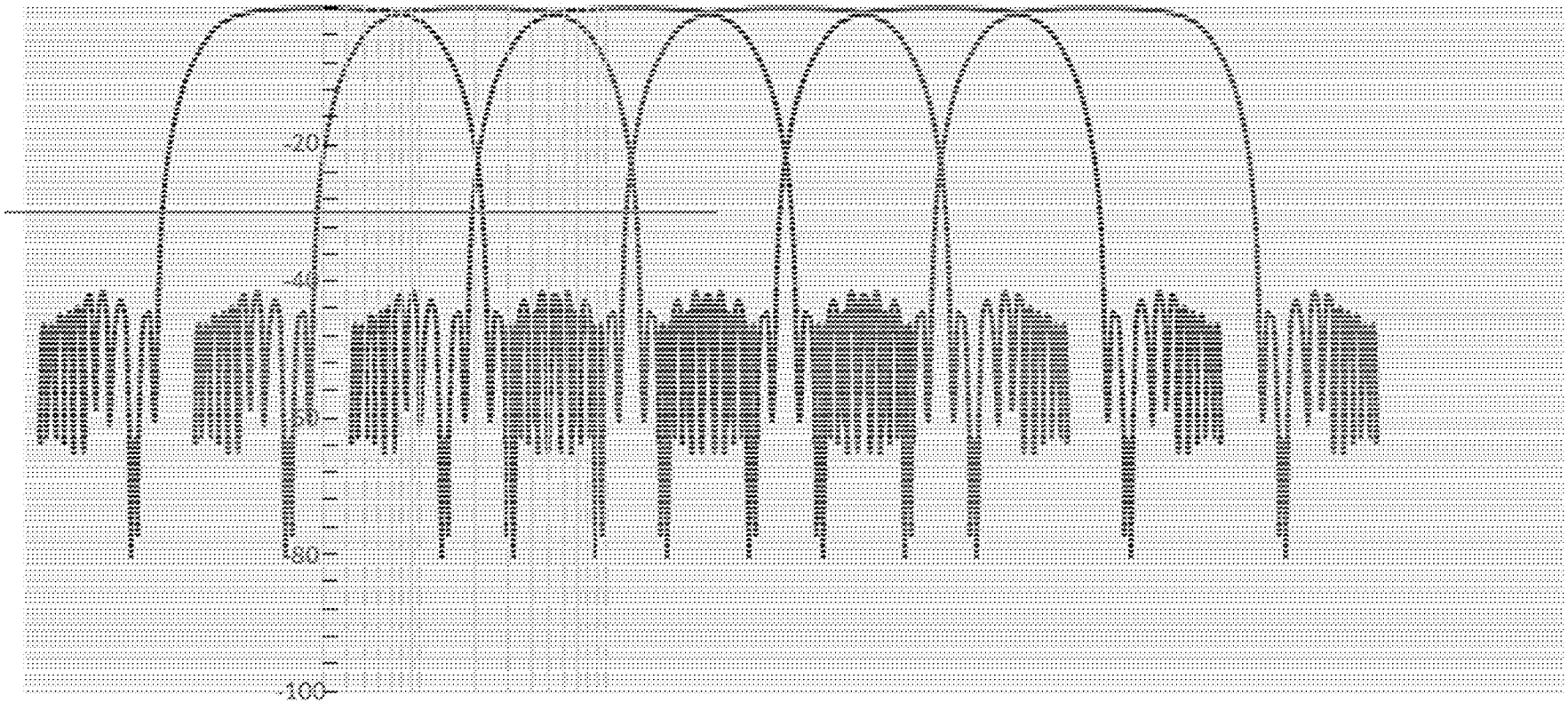
FIG. 31 shows another example of a multibeam antenna pattern.
Figure 32:
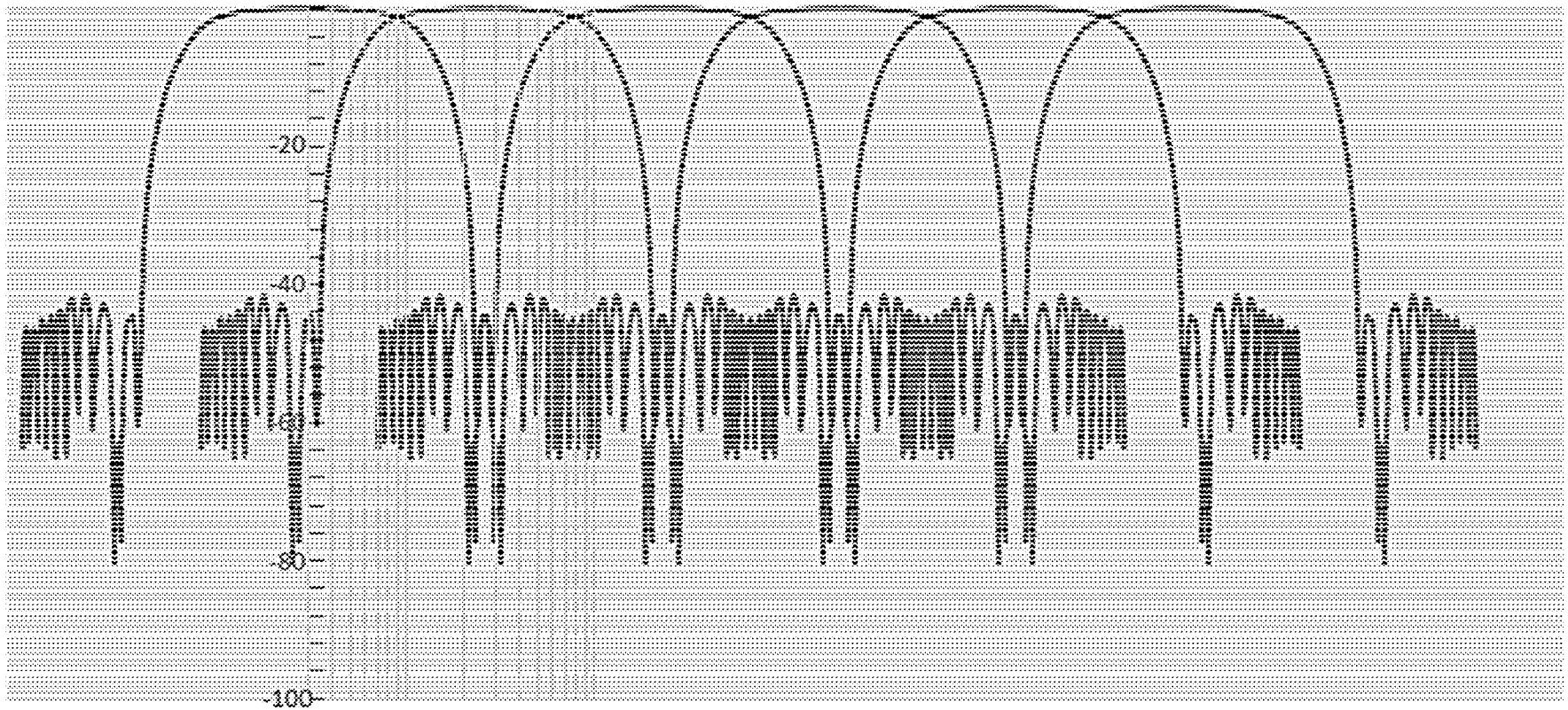
FIG. 32 shows another example of a multibeam antenna pattern.

FIG. 27 shows a multibeam radiation example of the Hann window, where the passband and stopbands of the radiation patterns are simplified for visual presentation on a linear scale.

FIG. 28, FIG. 29, FIG. 30, FIG. 31 and FIG. 32 graphically show the effect of varying separation between antenna elements resulting in varying amount of overlap between adjacent and other neighboring beam patterns.

Figure 33:
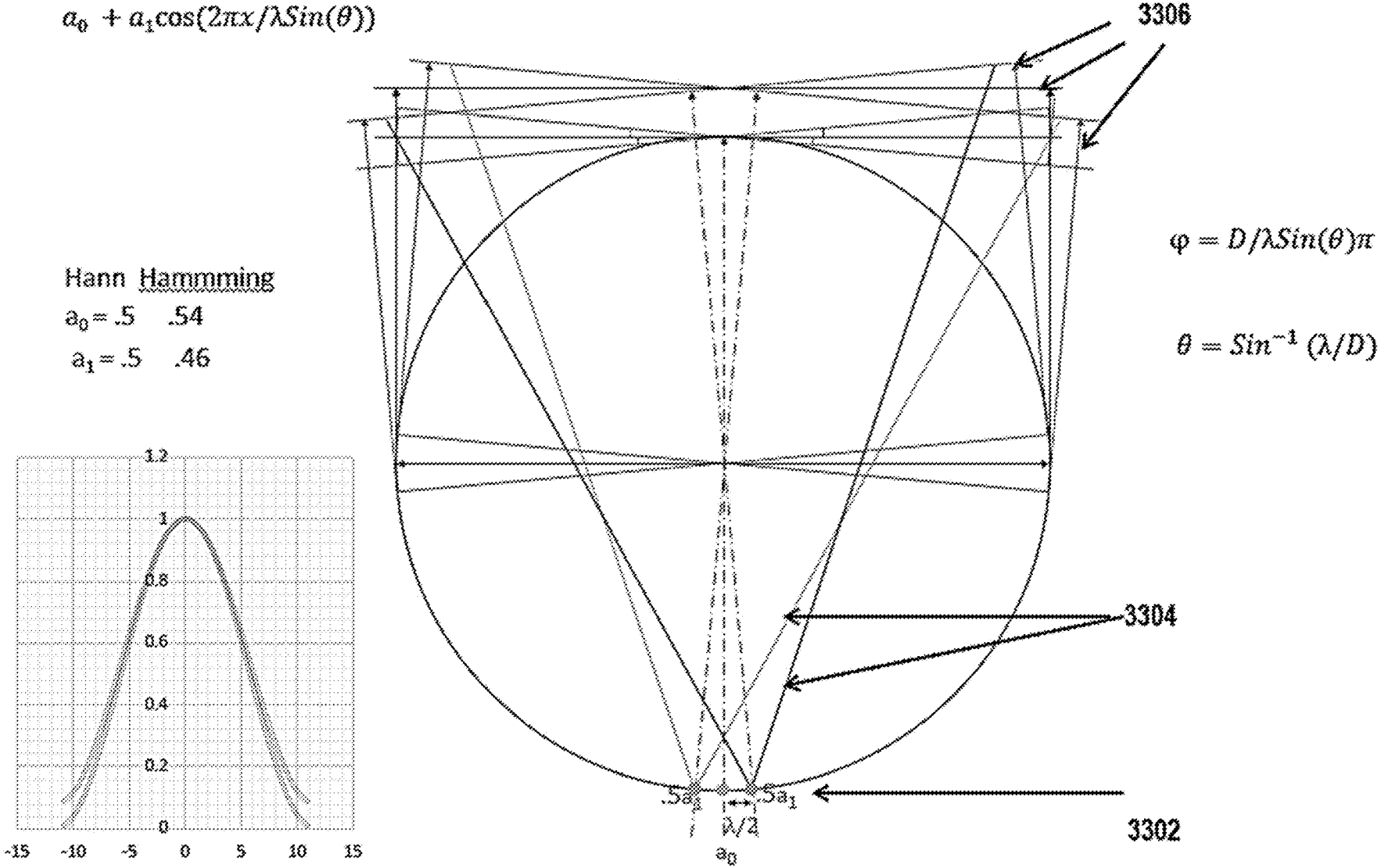
FIG. 33 shows an example beam generation using multiple radiation sources.

FIG. 33 shows an example beam generation using multiple radiation sources. Three antenna elements 3302 are located at half-wavelength distance around a hemispherical surface. The antenna elements 3302 radiate beams in the directions as depicted by 3304. At the radiating surface of the antenna, the radiations from each antenna elements appear as planar radiations, indicated by rectangles 3306.

A beam can be generated by splitting the input signal into multiple feeds, each feeding a corresponding antenna element after having gone through the attenuation coefficient a0 or a1. At the far end, the radiated signals proportionally add (and subtract) together to provide a windowed version of the beam. FIG. 33 depicts two windowing options—a Hann window with both a0 and a1 having values 0.5, and a Hamming window in which a0 is 0.54 and a1 are 0.46. In the depicted embodiment, three antenna elements are used to implement the windowing. It would be appreciated by one of skill in the art that, as described herein, a different number of antenna elements may be used for a window, with the corresponding taps, or attenuating coefficients, having values that provide the windowing effect to the final beam emanated due to the combination of radiation from each antenna element. Furthermore, the distance between antenna elements can also be adjusted to meet a target beam width and/or side lobe attenuation.

Figure 34:
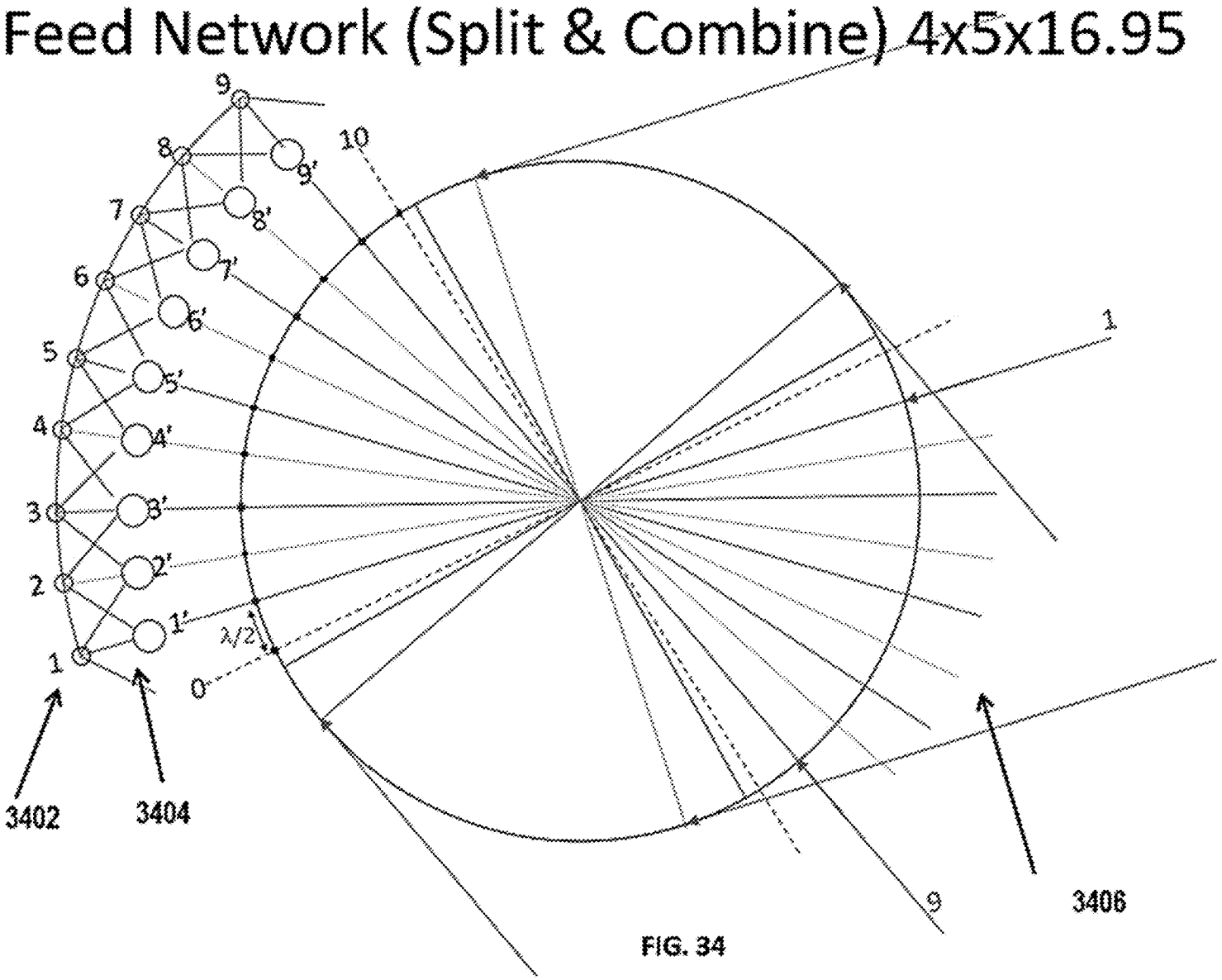
FIG. 34 shows an example of a feed network for beam shaping.

FIG. 34 shows an example of a feed network for forming multibeam patterns at antenna output. One or more beams 3402 (numbered 1 to 9 in the depicted embodiment) may be input to the multibeam antenna. Each beam may be split into a corresponding number of output feeds to the antenna elements 3404. During operation, beams 1, 3, 5, 7 and 9 may be operated simultaneously and beams 2, 4, 6, 8 may be operated simultaneously. As can be seen, by using 3-tap split for each beam, a windowing function can be implemented as described previously. Each antenna element 1' to 9' receives input from two beams at the same time. The resulting beam pattern emanating from the transmitting side 3406 of the antenna thus includes multiple beams, each windowed and having a main lobe and attenuated side lobes, in the direction as indicated by the straight line arrows from the antenna elements to the transmitting side 3406.

Figure 35:
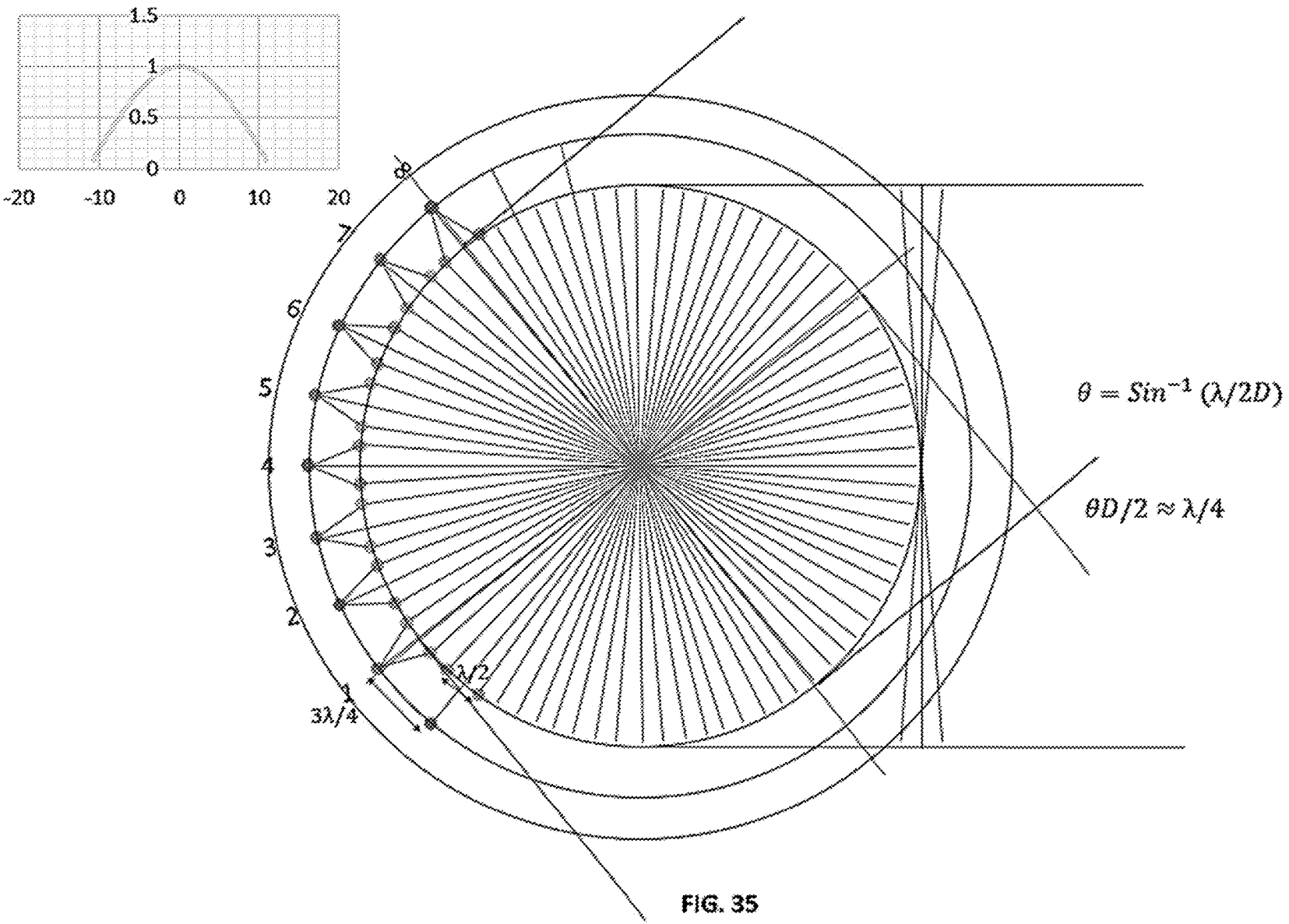
FIG. 35 shows an example of a feed network for beam shaping.

FIG. 35 shows an example of a feed network for beam shaping. In this feed network, multiple beams are split via a feed network into adjacent feeds that are placed at a fractional multiple of the operating wavelength k. The beam themselves may be separated by fractional multiple of the wavelength. For example, in the depicted embodiment, feeds are separated by λ/2 and the beams are separated by 3 λ/4. Compared to the antenna depicted in FIG. 34, the antenna embodiment of FIG. 35 uses a two-tap window, such as the previously described cosine window, such that each beam is split and fed to two antenna elements. As described in the present document and depicted, for example, in FIG. 3, the advantageous placement of multiple antenna elements (taps of a window filter) can be used to perform spatial windowing operation on the beams emanated from the antenna elements to achieve a directionality of transmission (or reception) along the main lobe of the windowed function.

In some embodiments, a lens antenna may be constructed to include multiple layers each having slightly different refractive index from its neighboring layers so that an antenna beam is formed when a radiative element is placed at or near the focal point of the lens antenna. The lens antenna could be one of several types. Some examples include Luneburg antenna, Eaton antenna, Goodman antenna, and so on. Only for the sake of illustration, Luneburg antenna is used as an example. The lens antenna may be fitted with multiple feeds to generate multiple antenna beams, as described herein.

Examples of Physical Parameters of Antenna Embodiments

In some embodiments, multiple feeds may be positioned such that the resulting beams may emanate spatially adjacent to each other. The signal being fed into each feed may be windowed using signal processing. The choice of window may affect the beamwidth of the main lobe and the attenuation of side lobes, which in turn relates to how much signals from one antenna element will interfere with signals from its neighboring antenna elements.

The separation between adjacent radiative elements may be selected to meet desired spatial separation and performance including values such as λ/2, 3 λ/4, and so on. In general, the spacing between feed elements will dictate the interference from harmonics.

In some embodiments, each radiative element may be placed at an offset from the focal point of the lens antenna, thereby spatially offsetting its beam from that of another radiative element.

The radiative elements may be modeled as point sources at aperture. The spacing between the feeds may detect the harmonics that interfere with each other. In some embodiments, the feed elements may be separated by one wavelength (λ) of the operating frequency band.

Multi-Dimensional Arrangements

In some embodiments, the radiative elements may be arranged in an array structure that is two dimensional—e.g., extends along azimuth and elevation of the lens antenna. The two-dimensional placement of the antenna elements provides an additional degree of freedom in generating widowed beam versions, where beams can be split and fed to antenna elements in a two-dimensional space to achieve a desired 2-dimensional windowing of the beam as it emanates out of the antenna. In some embodiments, the antenna may be shaped as half-cylinder instead of a hemisphere. In the cylindrical embodiment, the beams may be arranged along a first semi-cylinder and the feed elements may be organized along a concentric half-cylinder, with one dimension of placement along the curved surface of the cylinder and the other dimension of placement along the length of the cylinder.

Multi-Band Operation

In some embodiments, the lens antenna may be designed to operate in multiple frequency bands. Without loss of generality, some example embodiments of a two-band antenna operation are described herein, but it is understood that similar designs can be extended to antennas that are suitable for operation in more than two frequency bands. For example, a single antenna may be designed to operate both in the 3 GHz and in the 5 GHz cellular frequency bands. A separate set of feeds may be used for each band of operation, with the separation between feed elements for each frequency band being fractional multiple of the center frequency of operation of the corresponding band. However, because of the frequency separation between the bands and out-of-band attenuation of the beams, the same lens may be used for both bands, thereby allowing savings in the size and weight of the antenna.

In some embodiments, because separation of feed elements depends on the band of operation, the angular beam width may therefore depend on the frequency band of operation. As an example, using the same lens antenna, a beam width of 12 degrees may be achieved or 3 GHz operation, while a beam width of 9 degrees may be achieved for 5 GHz operation.

In some embodiments, these beam widths may be adjusted by placing the feed elements at an off-focal point that is closer or farther from the transmitting side. Appendix A provides some examples of such placement of antenna elements to achieve different beam widths. Therefore, in some embodiments, a same beam width can be achieved regardless of the band of operation.

Signal Processing to Cancel Effect of Neighboring Beams

In some embodiments, the interference caused by overlapping neighboring lobes can be cancelled by performing signal processing. Because a signal of a given beam may at most experience interference from a neighboring beam, but not from beams that are two or more lobes away, the effect of such interference can be cancelled by inverting a banded diagonal matrix that has non-zero entries along at most 3-diagonals. The matrix can be inverted relatively easily to recover signal for a specific user equipment. In such a formulation, beams and UEs can be written as columns of a matrix and the problem of isolating and separating signal to a specific UE can be posed as a matrix inversion problem. One of skill in the art will appreciate that such signal processing is much simpler than prior art MU-MIMO system calculations. The signal processing arrangement thus may be used to implement window functions as described in the present document, where the signals fed to the various antenna elements are weighted according to the window pattern, thus resulting in a spatial beam of the corresponding window spectral pattern.

Lens Antenna Embodiments

In some conventional lens antennas, a fiber glass lens may be used for signal transmission/reception. Such lenses tend to be prohibitively heavy and cannot be easily installed in compact installations. For example, fiber glass lenses could weigh as much as 400 lbs, and their deployment poses an operation challenge and relatively capex and opex.

The lens technology described herein can be embodied using layers of foam material that are shaped as concentric shells with increasing radii along a sphere. The foam may be made of an insulation material and the shells may be glued to each other for structural rigidity. For example, the entire lens antenna may include 6 to 12 shell layers that enclose each other. Such material is light in weight (e.g., total weight of 20 to 50 lbs) and can be transported and assembled on-site. In some embodiments, the lens antenna may be a Luneburg type lens antenna.

Tiling

In some embodiments, the shells may themselves be constructed as continuous sheets of material, bent into hemispherical shape. Alternatively, in some embodiments, the hemispherical shape may be achieved by joining together tiles of material into a hemispherical shape. The tiles may be joined, or stitched, to minimize surface discontinuities such that the beams emanating from the radiative elements have a beamwidth smaller than that of individual tiles so that beams are not distorted by the edges between tiles. For example, in some embodiments, square tiles of dimension 22 inches may be used to build a hemispherical lens antenna that can be installed on a neighborhood cellular tower.

Examples of Mesh Network Embodiments

In a typical mesh network scenario, devices within transmission range can discover each other and then establish communication. Conventional mesh networks can suffer from the shortcoming that nearby devices may interfere with each other's transmission. In some embodiments, the lens antenna technology described herein could be used to establish dense mesh networks. A transmitter may initially start transmission in omni-directional mode. Using the omni-directional transmission and reception, the device may discover nearby devices. Once nearby devices are discovered, signal processing may be performed to form beams for communicating with these devices. Therefore, interference with other devices is minimized using the lens antenna technology.

Examples of Satellite Communication Embodiments

In some embodiments, a wireless access device may be installed in a neighborhood. The access device may enable connectivity of user devices in the neighborhood to the Internet. For example, the access device may be able to communicate with user devices using the ubiquitously available communication interfaces such as LTE or Wi Fi. At the same time, the access device may also communicate with a satellite for wide area access, thereby allowing user devices to be communicatively connected with wide area of coverage. In some examples, the access device may be operated to communicate with the satellite using the multibeam technology described herein. For example, the lens antenna of the access device may form multiple beams in the directions of the satellite and user devices.

Examples of Relay Embodiments

In some embodiments, a multi-beam antenna may be used to establish communication with user devices and wide area network. In some embodiments, user devices may use a return path (uplink) via a network that is different from the network over which the downlink signal is received via a relay device that communicates using a multibeam antenna.

Examples of Automotive Embodiments

The multibeam antenna technology described herein may also be used in implementations of automotive communication. For example, a car may be fitted with a communication device that uses a multibeam lens antenna for communication with other automobiles or other network nodes. In some embodiments, a hemispherical antenna may be fitted on the roof of a car. In some embodiments, the antenna may be cylindrical in shape and this shape may be used to generate a wider beam (main lobe).

Figure 36:
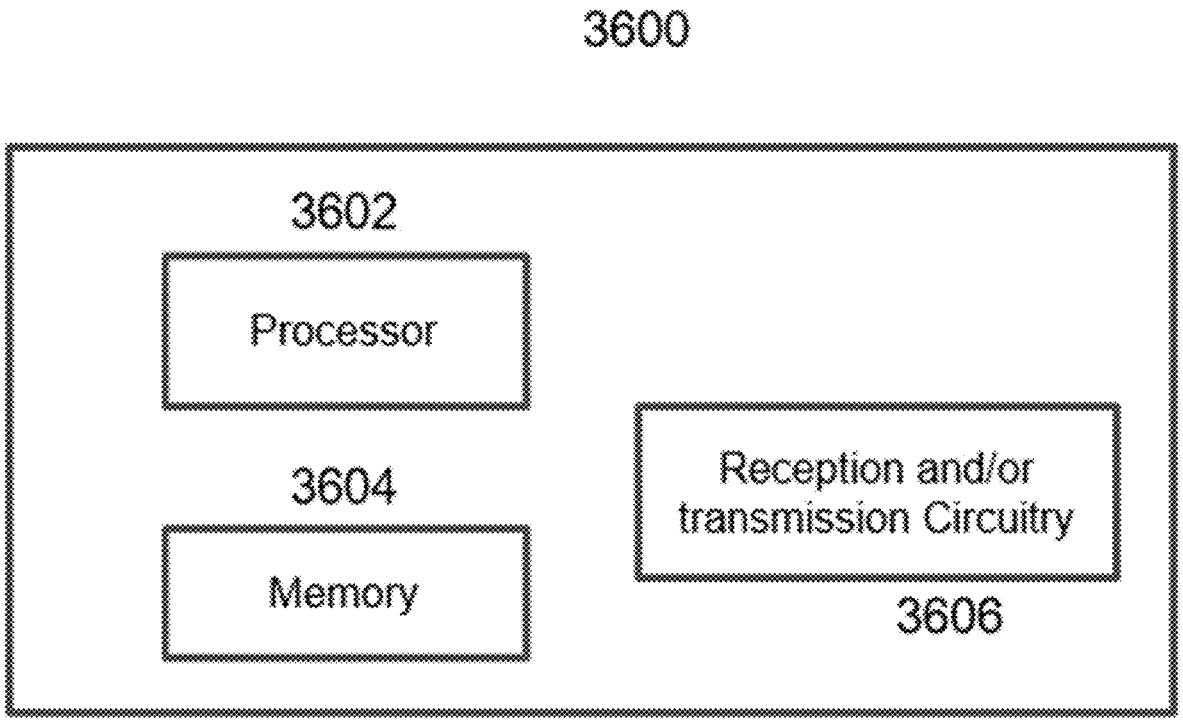
FIG. 36 shows an example of a wireless transceiver apparatus.

FIG. 36 shows an example of a wireless transceiver apparatus 3600. The apparatus 3600 may be used to implement various techniques described herein. The apparatus 3600 includes a processor 3602, a memory 3604 that stores processor-executable instructions and data during computations performed by the processor. The apparatus 3600 includes reception and/or transmission circuitry 3606, e.g., including radio frequency operations for receiving or transmitting signal and/or receiving data or information bits for transmission over a wireless network.

In some embodiments, an antenna system includes a lens portion that is hemispherical in shape and comprises multiple hemispherical concentric shells having varying radio frequency refractive indices, and one or more antenna elements arranged in a three-dimensional array, each antenna element communicatively coupled to one or more radio frequency (RF) transmit or receive chain and being able to transmit or receive data from a corresponding transmit or receive chain according to a transmission scheme.

In some embodiments, an antenna system includes multiple data stream inputs, each data stream input carrying source data bits for one or more users, a signal processing stage that processes the multiple data stream inputs to generate multiple beams, where each beam represents a signal carried over one radio frequency beam, a feed network that couples each of the multiple beam to a number of antenna elements, and a lens portion positioned to radiate radio frequency transmissions from the antenna elements in a target direction.

In some embodiments, e.g., as depicted in FIG. 37, an antenna system 3700 (with its side view 3702) includes a lens portion 3708 that is semi-cylindrical in shape and comprises multiple semi-cylindrical concentric shells having varying radio frequency refractive indices, and one or more antenna elements 3704 arranged in a three dimensional array, each antenna element communicatively coupled to one or more radio frequency transmit and/or receive chain and being able to transmit and/or receive data from a corresponding chain according to a transmission scheme. The antenna elements 3704 may be arranged along a flat surface 3706 of the semi-cylindrical lens portion 3708.

In some embodiments, an antenna system includes a lens portion that is spherical in shape and comprises multiple spherical concentric shells having varying radio frequency refractive indices, and one or more antenna elements positioned at or near a focal point of the lens portion, each antenna element communicatively coupled to one or more radio frequency transmit and/or receive chain and being able to transmit and/or receive data from the beams according to a transmission scheme.

In some embodiments, an antenna system includes a lens portion having a radiation-side curved surface and a feed reception surface, the lens portion structured to focus radio frequency radiations entering from the radiation-side curved surface on a focal point located at the feed reception surface, and one or more antenna elements positioned at or near the focal point, the one or more antenna elements being separated from each other by a fractional multiple of a center wavelength of a frequency band of operation, and each antenna element communicatively coupled to one or more radio frequency transmit and/or receive chain and being able to transmit and/or receive data from the radio frequency transmit chain according to a transmission scheme.

In some embodiments, an antenna system includes a lens portion that is semi-cylindrical in shape, and one or more antenna elements arranged in a three dimensional array on a surface of the lens, each antenna element communicatively coupled to one or more radio frequency transmit and/or receive chain and being able to transmit and/or receive data from a corresponding chain according to a transmission scheme.

Figure 38:
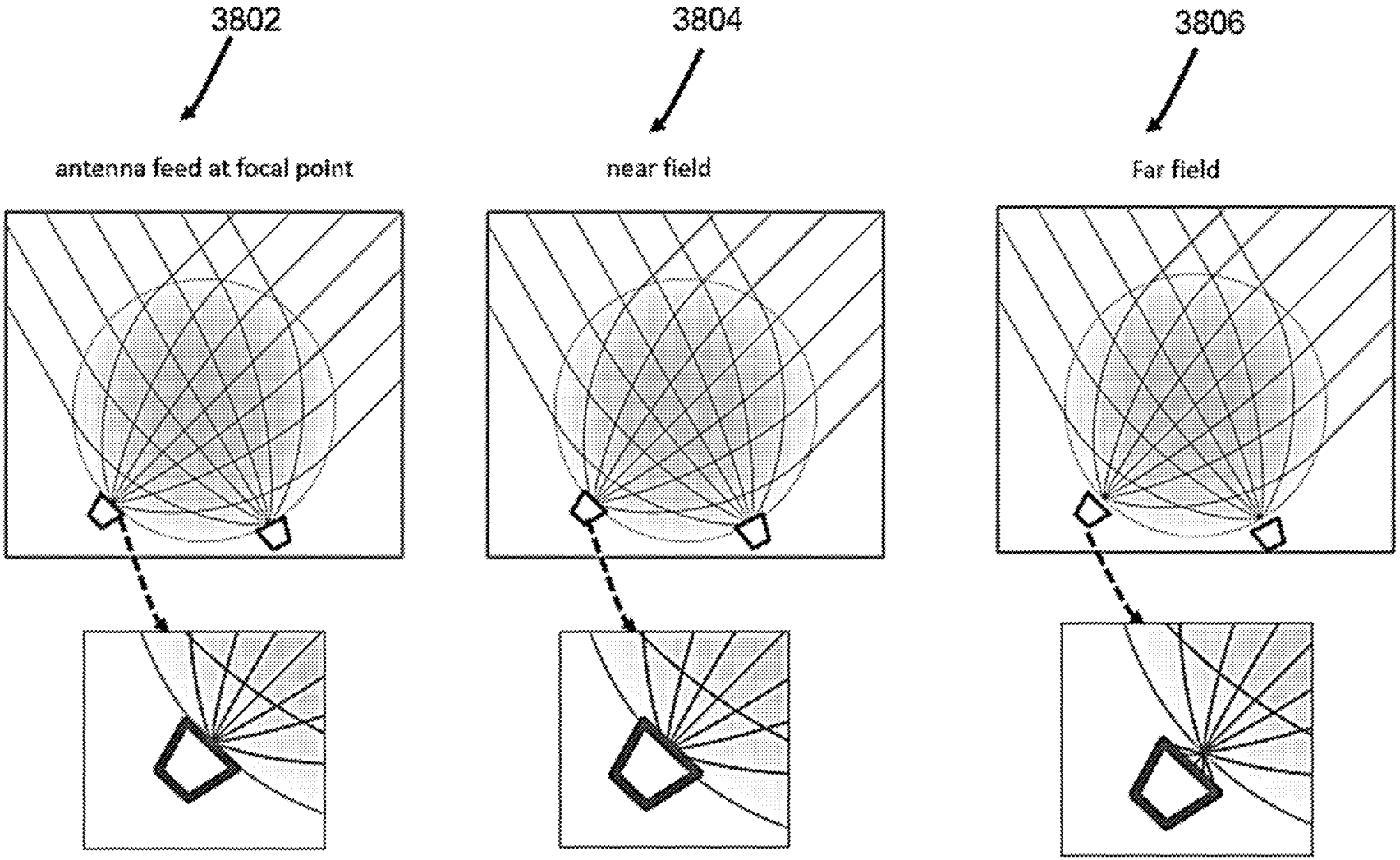
FIG. 38 shows examples of focal and off-focal placement of antennas in an antenna system.

The various antenna system embodiments described herein and their various features can be seen in the illustrations in FIG. 3, and FIG. 33 to FIG. 38 and the associated description, In particular, FIG. 38 shows some embodiments that show the three-dimensional placement of antenna elements where two-dimensional arrays are placed at a location at the focal point (3802) closer than the focal point (3804, closer to the radiation-side curved surface of the lens) and/or farther than the focal point (3806, away from the radiative surface) and/or in the focal plane. While spherical lenses are depicted in the illustration of FIG. 38, similar placement of arrays of radiative antenna elements can be used with hemispherical and semi-cylindrical lenses. In arrangement 3806, the antenna feed is off-focal point in a direction away from the lens. As a result, received signals may first converge at a focal point and then begin to diverge beyond the focal point prior to impinging on the surface of the antenna feed. Similar to the arrangement 3804, when multiple antenna feed elements are located on the surface of the antenna feed, in the arrangement 3806, the multiple antenna feed elements may receive/transmit signals similar to each other in strength.

With respect to the above-described antenna systems, in some embodiments, the antenna elements may be configured to transmit and receive using time division multiplexing. In such a mode of operation, the antenna beam patterns may be adjusted by using different windowing weights on a time slot by time slot basis, which may thus act as receiving antenna in one time slot and a transmitting antenna in another time slot. In a frequency division multiplexing mode of operation, the antenna elements may be simultaneously acting in two different frequency bands—in one band, for receiving signals, and in another band for transmitting signals. In such a mode of operation, the windowing functions and gains may be adjusted to match the corresponding target transmission or reception signal to noise ratios. This may be achieved, for example, by adjusting the signal processing gains in the stream processing stage, as depicted in FIG. 3. For example, using the cascaded three-step arrangement in FIG. 3, a windowing function that may include a multiplicative effect of up to three cascaded windows may be achieved. For example, feeds 306 (number and power) may be controlled to feed the multibeam antenna 312, to achieve beam-selective signal power radiation. In turn, each feed element may be generated from the feed network 310 based on the corresponding signal inputs that map to beams 304. The signal processing stage 308 may perform additional windowing of signals by linearly weighting the streams 302 that represent data transmissions to/from groups of far-end devices (e.g., user equipment) to which data is being transmitted, or from which data is being received.

In some embodiments, a data communication method may include receiving and/or transmitting RF signals using one of the antenna embodiments described herein.

In some embodiments, a method of forming a mesh network includes performing, during a discovery phase, omnidirectional signal transmission to cover a range of operation, receiving acknowledgements from one or more other devices during the discovery phase, and modifying the omnidirectional signal transmission into a multibeam transmission such that each beam of the multibeam transmission cover the one or more other devices from whom the acknowledgements are received. The mesh network formation may be performed by an apparatus having an antenna system as described herein.

The disclosed and other embodiments, modules and the functional operations described in this document can be implemented in digital electronic circuitry, or in computer software, firmware, or hardware, including the structures disclosed in this document and their structural equivalents, or in combinations of one or more of them. The disclosed and other embodiments can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

The processes and logic flows described in this document can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

While this patent document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few examples and implementations are disclosed. Variations, modifications, and enhancements to the described examples and implementations and other implementations can be made based on what is disclosed.

What is claimed is:

1. An antenna system, comprising:

a multibeam lens antenna having a radiation-side curved surface and a feed reception surface, the lens antenna structured to focus radio frequency (RF) radiations entering from the radiation-side curved surface on a focal point located at the feed reception surface; and antenna elements positioned at or near the focal point, the antenna elements being separated from each other by a one-half integer multiple of a center wavelength of a frequency band of operation, wherein each of the antenna elements is communicatively coupled to at least one RF transmit chain and at least one RF receive chain, and each of the antenna elements being able to transmit and/or receive data from the at least one RF transmit chain according to a transmission scheme of the frequency band of operation;

wherein the communicative coupling of each antenna element to the at least one RF transmit chain and the at least one RF receive chain includes an attenuation factor that causes beams emitted from the antenna elements to undergo a windowing operation when emanating from the antenna system;

wherein the antenna elements are configured to operate in 3 GHz and 5 GHz cellular frequency bands.

2. The antenna system of claim 1, wherein the windowing operation comprises a cosine windowing operation.

3. The antenna system of claim 1, wherein the windowing operation comprises a Hamming windowing operation.

4. The antenna system of claim 1, wherein the windowing operation comprises a Hann windowing operation.

5. The antenna system of claim 1, wherein the radiation-side curved surface is semi-cylindrical.

6. The antenna system of claim 1, wherein the radiation-side curved surface is hemispherical.

7. The antenna system of claim 5, wherein the antenna elements are positioned in a focal plane of the multibeam lens antenna.

8. The antenna system of claim 5, wherein the antenna elements are positioned closer to the radiation-side curved surface than the focal point.

9. The antenna system of claim 5, wherein the antenna elements are positioned farther from the radiation-side curved surface than the focal point.

10. The antenna system of claim 5, wherein the antenna elements are arranged in an array structure.

11. The antenna system of claim 6, wherein the antenna elements are positioned in a focal plane of the multibeam lens antenna.

12. The antenna system of claim 6, wherein the antenna elements are positioned closer to the radiation-side curved surface than the focal point.

13. The antenna system of claim 6, wherein the antenna elements are positioned farther from the radiation-side curved surface than the focal point.

* * * * *